US008398528B2

(12) United States Patent
Fukunaga

(10) Patent No.: US 8,398,528 B2
(45) Date of Patent: Mar. 19, 2013

(54) SPINAL CORRECTION DEVICE

(76) Inventor: Mikio Fukunaga, Kanagawa (JP)

( * ) Notice: Subject to any disclaimer, the term of this patent is extended or adjusted under 35 U.S.C. 154(b) by 165 days.

(21) Appl. No.: 12/557,830

(22) Filed: Sep. 11, 2009

(65) Prior Publication Data

US 2010/0087302 A1 Apr. 8, 2010

(30) Foreign Application Priority Data

Oct. 6, 2008 (JP) ..... 2008-260176
Jan. 13, 2009 (JP) ..... 2009-005110

(51) Int. Cl.
*A63B 22/00* (2006.01)
*A63B 22/14* (2006.01)
*A61H 1/02* (2006.01)

(52) U.S. Cl. ..... 482/51; 482/146; 601/23

(58) Field of Classification Search ..... 482/79, 482/80, 145, 146, 147, 148, 907, 6, 8, 9, 482/51, 62; 602/19, 33; 606/237; 601/23–36
See application file for complete search history.

(56) References Cited

U.S. PATENT DOCUMENTS

| | | | | |
|---|---|---|---|---|
| 3,964,742 | A * | 6/1976 | Carnielli | 482/7 |
| 5,290,211 | A | 3/1994 | Stearns | |
| 5,545,111 | A * | 8/1996 | Wang et al. | 482/53 |
| 5,947,873 | A * | 9/1999 | Sands et al. | 482/52 |
| 6,179,752 | B1 * | 1/2001 | Chang | 482/52 |
| 6,213,924 | B1 * | 4/2001 | Kaiyoorawongs | 482/146 |
| 6,692,419 | B2 * | 2/2004 | Chen | 482/146 |
| 6,709,367 | B1 * | 3/2004 | Liang | 482/53 |
| 2004/0097337 | A1 * | 5/2004 | Chuang | 482/52 |
| 2005/0043143 | A1 * | 2/2005 | Chuang | 482/51 |
| 2007/0167290 | A1 * | 7/2007 | Kim | 482/54 |
| 2008/0020915 | A1 * | 1/2008 | Pacheco et al. | 482/146 |
| 2012/0322620 | A1 * | 12/2012 | Nishimura | 482/6 |

FOREIGN PATENT DOCUMENTS

| | | | |
|---|---|---|---|
| JP | 7-308405 | A | 11/1995 |
| JP | 10-511021 | A | 10/1998 |
| JP | 11-188119 | A | 7/1999 |
| JP | 11-313905 | A | 11/1999 |
| JP | 2000-51392 | A | 2/2000 |
| JP | 2000-511073 | A | 8/2000 |
| JP | 2002-325783 | A | 11/2002 |
| JP | 2004-089727 | A | 3/2004 |
| JP | 2004-181179 | A | 7/2004 |
| JP | 2005-102798 | A | 4/2005 |
| JP | 2005-514126 | A | 5/2005 |
| JP | 3119134 | U | 1/2006 |
| JP | 2006-187590 | A | 7/2006 |
| JP | 2006-223791 | A | 8/2006 |
| JP | 2006-526456 | A | 11/2006 |
| JP | 2007-29704 | A | 2/2007 |
| JP | 2008-29712 | A | 2/2008 |

* cited by examiner

*Primary Examiner* — Stephen Crow
(74) *Attorney, Agent, or Firm* — Birch, Stewart, Kolasch & Birch, LLP

(57) ABSTRACT

A spinal correction device that corrects the spinal column of a user comprising a lower limb exercising part that swings the lumber region to impart a symmetrical motion to positions symmetrical with respect to the spinal column of a user facing forward with his or her trunk erect, a pair of gripping parts provided in a position in front of the lower limb exercising part and gripped by both hands of the user, and a control unit that relatively moves the gripping parts with respect to the lower limb exercising part between the position in front of the lower limb exercising part and a lateral position, with the lower limb exercising part in a driven state.

4 Claims, 28 Drawing Sheets section II - II section VI-VI section V-V section VIII-VIII section IX-IX section IX-IX

SPINAL CORRECTION DEVICE

BACKGROUND OF THE INVENTION

1. Field of the Invention

The present invention relates to a spinal correction device for correcting the spinal column of a user.

2. Description of the Background Art

When a person's spinal column is corrected by a chiropractor, for example, correction is made by employing displacement to the vertebrae by use of his hands to adjust the position of the vertebrae.

There is also a method in which a spinal column correction effect is achieved by stimulating the erector spinal muscle segment that supports the vertebrae constituting the spinal column by chiropractor's hands, which activates the contractile force of the erector spinal muscle segment.

For example, in a case where a transversospinal muscle of an erector spinal muscle segment has been fully stretched as a result of spinal distortion, this method imparts a motion that repeatedly pulls the muscle to an even further stretched state, inducing activation of the contractile force of the transversospinal muscle.

According to the transversospinal muscle thus subjected to contractile force activation, the spinal distortion is resolved on its own, achieving spinal correction.

Now, development of a spinal correction device that achieves a self-correcting effect of the spinal column by activating the contractile force of an erector spinal muscle segment as described above without depending on a specialist such a chiropractor has been long awaited.

In order to activate the contractile force of a specific erector spinal muscle segment using a device and to achieve a self-correcting effect of the spinal column similar to that achieved by hands of a specialist such as a chiropractor, repeated motion must be properly imparted to a specific area.

That is, precise adjustment of the relative positional relationship between the user and the spinal correction device is required. The structure of a positioning mechanism device for such adjustment becomes complicated, and such a device tends to be large in size.

The present invention was developed in light of the above circumstances, and it is therefore an object of the present invention to provide a spinal correction device that is small in size, easily assembled, and capable of simply correcting the spinal column.

SUMMARY OF THE INVENTION

The spinal correction device according to the present invention, which corrects the spinal column of a user, comprises a lower limb exercising part that imparts motion to symmetrical positions of the pelvis with respect to the spinal column of said user facing forward with his or her trunk erected, thereby swinging the lumbar region, a pair of gripping parts provided in a position in front of said lower limb exercising part and gripped by both hands of said user, and a control unit that relatively moves said gripping parts with respect to said lower limb exercising part, between said position in front of said lower limb exercising part and a lateral position, with said lower limb exercising part in a driven state.

According to the device of the present invention, the spinal column is twisted, thereby stretching the transversospinal muscle of an erector spinal muscle segment into a stretched state, in accordance with spinal distortion. Then, motion is imparted to symmetrical positions on each side of the spinal column of the user to swing the lumbar region, thereby stabilizing the position of the lumbar region and transmitting short, quick oscillation to the vertebrae of the spinal column. Particularly, this oscillation is absorbed in the section where spinal distortion has occurred, causing the transversospinal muscle related to that section to repeatedly shift from a stretched state to an even further stretched state. That is, with the device, it is possible to simply correct a spinal column in which distortion has occurred without requiring precise adjustment of the relative positional relationship of the user and the spinal correction device. According to such an invention, a mechanism for positioning the user to the spinal correction device is not needed, making it possible to achieve a device that is small in size and easily assembled.

According to the device of the above-described invention, said lower limb exercising part may swing said lumber region via both limbs with said user in a standing state. From the lower limbs, motion is imparted to horizontally symmetrical positions of the pelvis with respect to the spinal column. The lower limb exercising part imparts motion to horizontally symmetrical positions of the pelvis with respect to the spinal column to swing the lumbar region of the user, thereby stabilizing the position of the lumbar region and transmitting short, quick oscillation to the vertebrae.

According to the device of the above-described invention, said lower limb exercising part may further include a footboard that moves the left and right of said lower limbs of said user vertically in opposite phases. Because a vertical motion of opposite phases is thus imparted to the left and right of the lower limbs, and the connecting position of the spinal column and pelvis is positioned at the substantial center of the swing of the pelvis, short, quick oscillation is transmitted to the vertebrae.

According to the device of the above-described invention, said lower limb exercising part may be a footboard that swings about an axis causing the underside surfaces of the feet of said lower limbs of said user to incline backwards and forwards, with said axis arranged directly beneath the spinal column of said user. With the axis that extends in the horizontal direction of the user arranged directly beneath the spinal column so that the underside surfaces of the feet of the lower limbs of the user are caused to incline backwards and forwards, vertical motion of respectively opposite phases is imparted to anteroposterior symmetrical positions of the pelvis with respect to the spinal column. The motion performed when the user attempts to balance in a standing position is thus achieved and short, quick oscillation is transmitted to the vertebrae.

According to the device of the above-described invention, said pair of gripping parts may be provided at both ends of a single rod arranged horizontally. The user can suitably select whether to grip the gripping parts in a supinated position or a pronated position. Particularly, in a case where the gripping parts are gripped in a supinated position, the underarms of the upper limbs become more tightened than in a case where the gripping parts are gripped in a pronated position, thereby stabilizing the position of the trunk. With this arrangement, the oscillation is sufficiently absorbed in the section where spinal distortion had occurred, causing the transversospinal muscle related to that section to repeatedly shift from a stretched state to an even further stretched state.

According to the device of the above-described invention, said rod may swing while maintaining a horizontal position in the circumference of a rotational axis in the vicinity of the center in the longitudinal direction. With the introduction of oscillation from both upper limbs to the shoulder region with the spinal column therebetween, the center axis of the twist of the spinal column following the longitudinal direction of the spinal column is defined, thereby stabilizing the posture of the user.

DESCRIPTION OF THE PREFERRED EMBODIMENTS

First, the principle behind achieving the spinal correction effect according to the present invention will be described.

Figure 1:
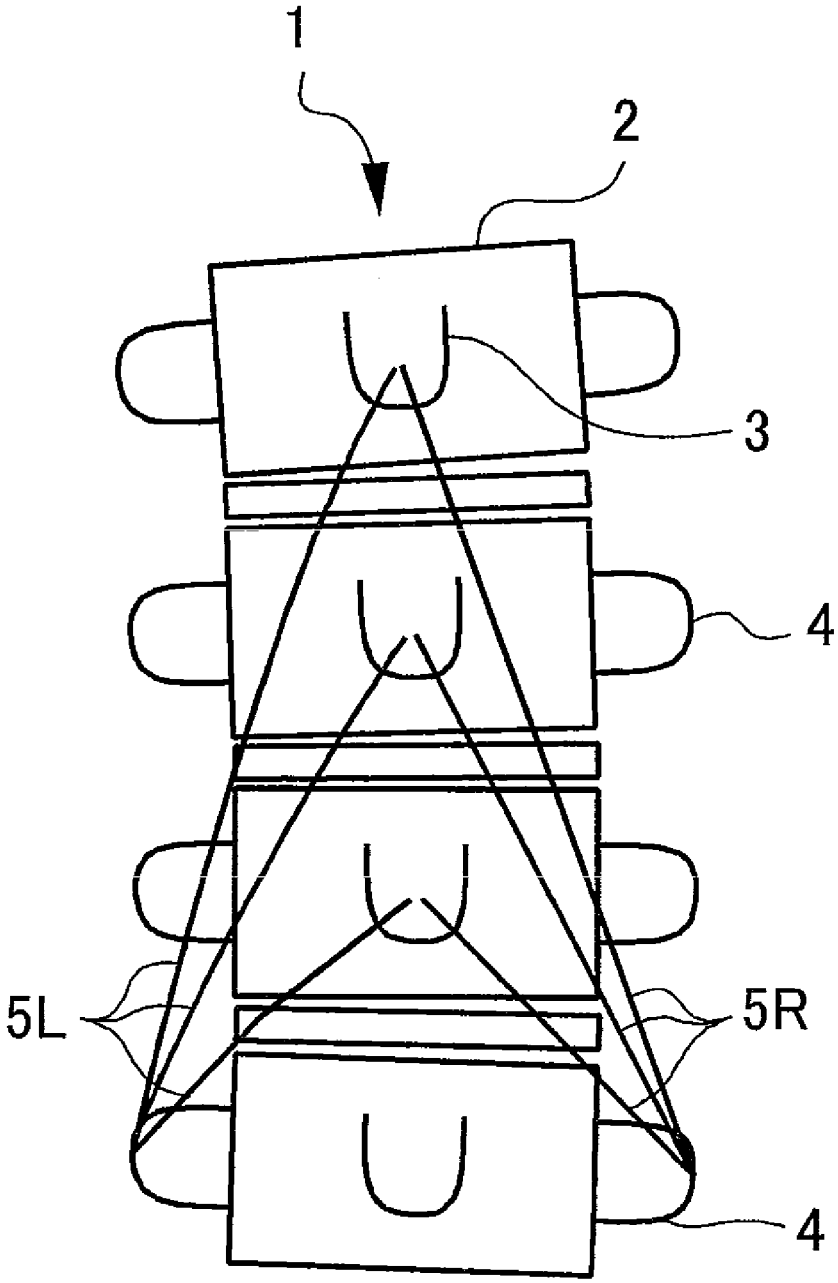
FIG. 1 and FIG. 2 are diagrams illustrating the principle of spinal correction.

As illustrated in FIG. 1, transversospinal muscles 5L and 5R of an erector spinal muscle segment (not shown) for supporting a vertebra 2 constituting a spinal column 1 are muscles that connect a transverse process 4 lateral to the vertebra 2 and a spinous process 3 rearward to (on the rear side of) the vertebra 2. When the spinal column is laterally bent, for example, one transversospinal muscle 5R of the left and right transversospinal muscles (5L and 5R) stretches. If the person is healthy, the lateral bend of the spinal column 1 is resolved by the contractile force of the transversospinal muscle 5R. Nevertheless, in a case where the contractile force of the transversospinal muscle 5R has decreased, the lateral bend of the spinal column 1 cannot be resolved. The spinal column 1 that cannot fully resolve a lateral bend, that is, the spinal column 1 having a chronic lateral bend, tilts toward the side of the lateral bend.

Figure 2:
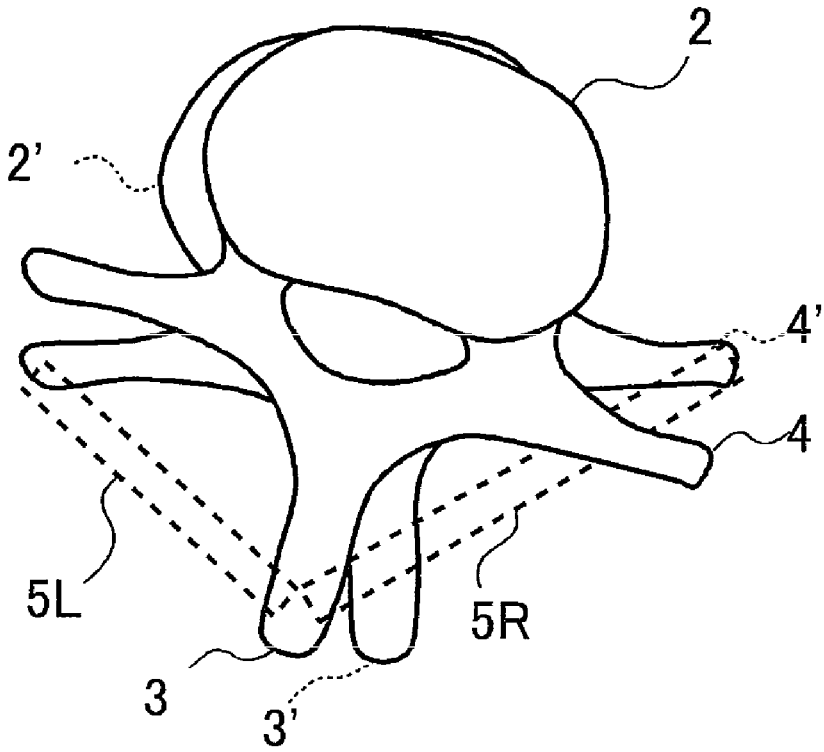

As illustrated in FIG. 2, when a twist is imparted to the spinal column 1, the distance between a transverse process 4' of a vertebra 2' positioned downward (in the back in the drawing) and the spinous process 3 of the vertebra 2 positioned upward increases, causing the transversospinal muscle 5R to be stretched. Subsequently, along with this stretching of the transversospinal muscle 5R, a motion that swings the lumbar region is imparted to the body with its upper half in an erected state. Then, the swing of the lumbar region causes the vertebrae 2 and 2' to make quick, short oscillations with respect to one another and absorb the swing. That is, the motion that causes the lumbar region to swing imparts a repeated motion of shifting between a stretched state and an even further stretched state to the transversospinal muscle 5R. As a result, the contractile force is activated in the transversospinal muscle 5R having a decreased contractile force and, once the above-described twist of the spinal column 1 is released, the lateral bend of the spinal column is resolved by the activated contractile force, thereby correcting the spinal column.

Next, the spinal correction device of one embodiment of the present invention will be described with reference FIG. 3 to FIG. 11.

Figure 3:
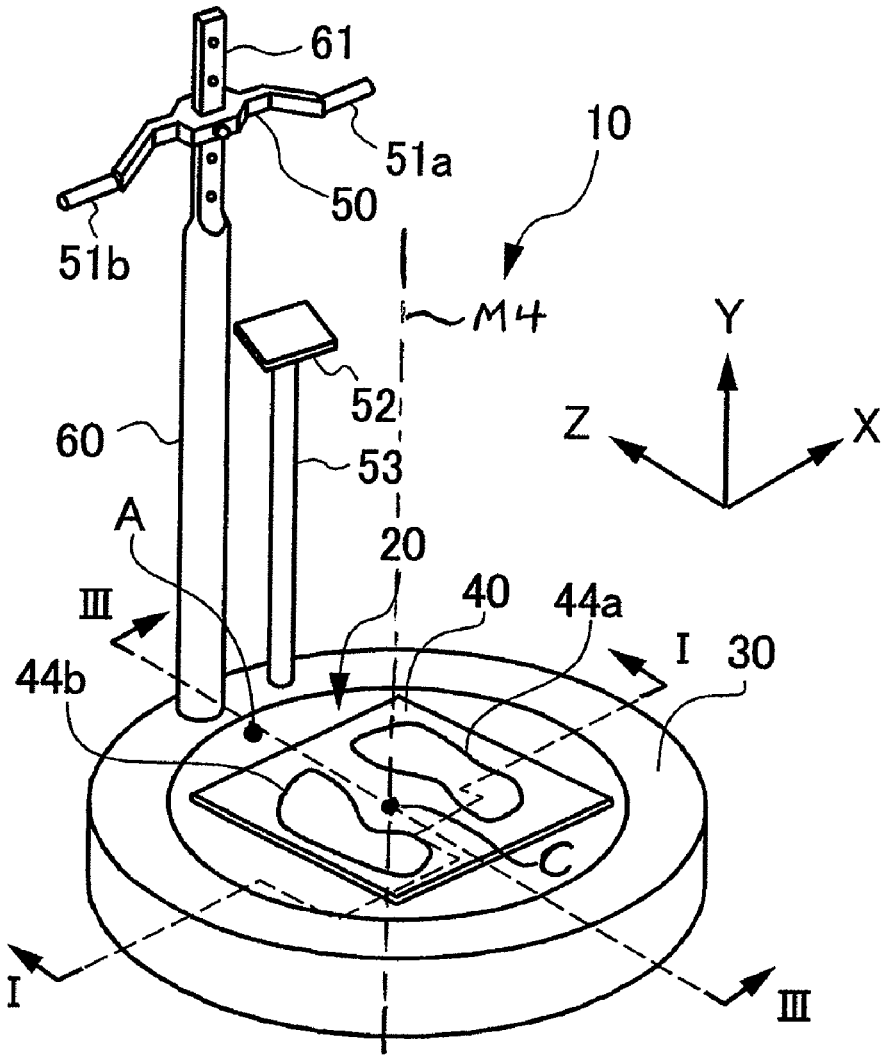
FIG. 3 is a perspective view of a spinal correction device according to the present invention.

As illustrated in FIG. 3, a spinal correction device 10 comprises a lower limb exercising part 20 of a cylindrical shape that is installed on a base provided with a footboard 40 of a substantially square shape, a rotating part 30 of a circular shape that covers the outer peripheral side of the lower limb exercising part 20, a rotating pillar 60 of a cylindrical shape that extends perpendicularly upward from the rotating part 30, a pillar 53 that is near the rotating pillar 60 and extends perpendicularly upward from the rotating part 30, and an operation unit 52 arranged on the upper end of the pillar 53. A handle 50 is engaged to an engaging part 61 of the upper part of the rotating pillar 60. Here, the X axis, Y axis, and Z axis are defined as illustrated in FIG. 3. That is, facing the rotating pillar 60 of the drawing from the center of the footboard 40, the rightward direction is +X, the upward direction is +Y, and the frontward direction is +Z. Further, a reference point A is provided in front of (in the +Z direction) of the lower limb exercising part 20. A pair of gripping parts 51*a*, 51*b* is provided at opposite ends of handle 50 which is arranged horizontally at an upper end of rotating pillar 60. Rotating pillar 60 is mounted forward of the lower limb exercising part 20. The upper limbs of the user are moved by the pair of gripping parts 51*a*, 51*b* which rotates around the vertical axis M4 passing through the center C of said footboard 40, from a forward orientation to a lateral orientation.

Figure 4:
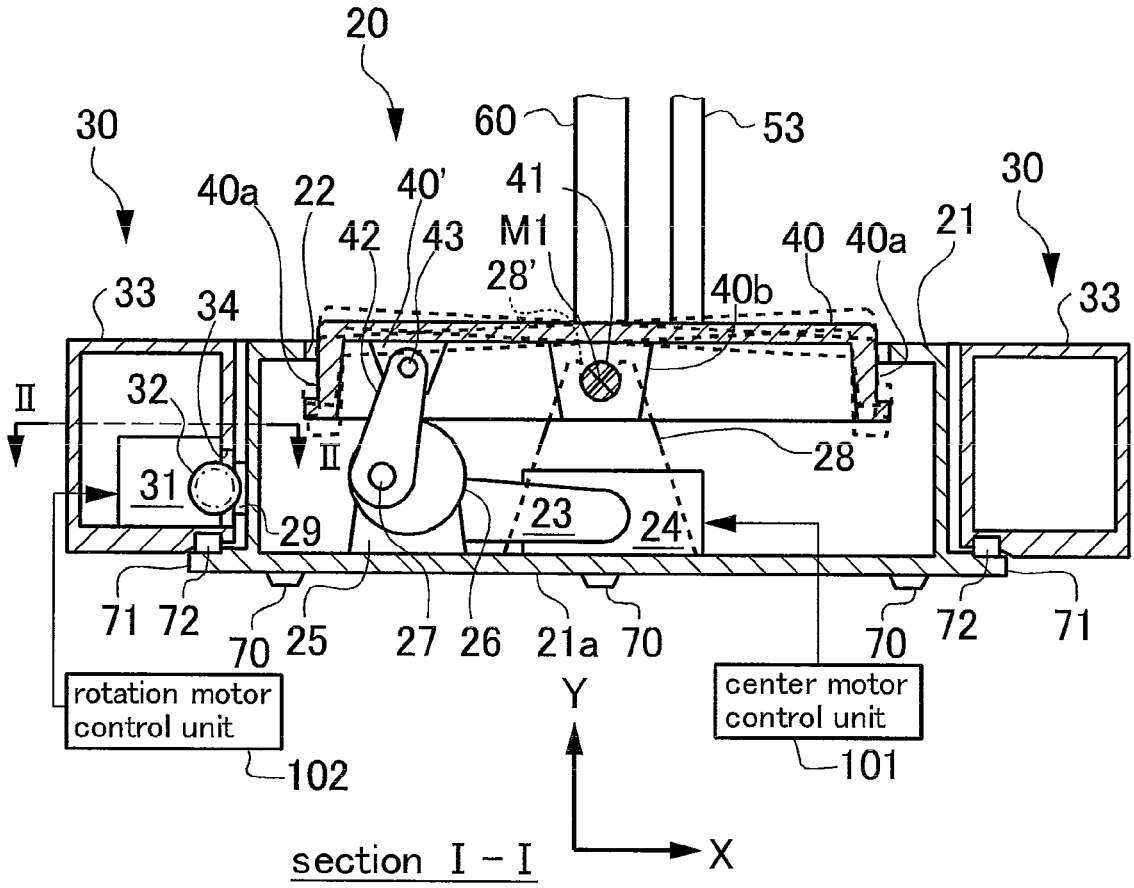
FIG. 4 is a cross-sectional view (cross-section I-I) of the main section of a spinal correction device according to the present invention.
Figure 5:
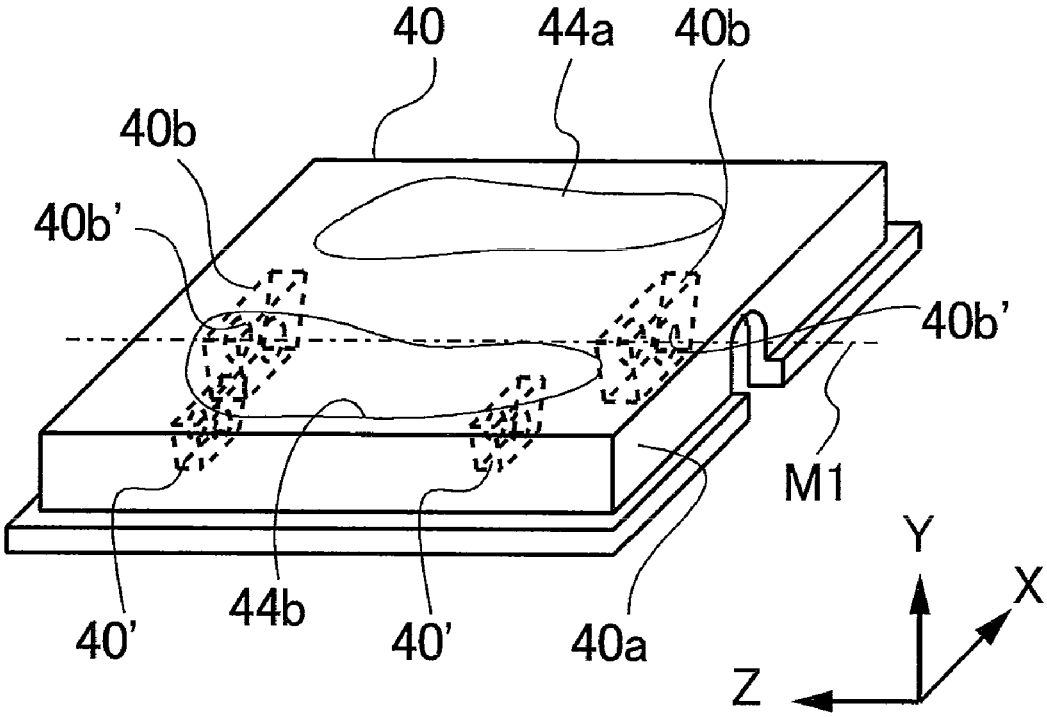
FIG. 5 is a perspective view of the main section of a spinal correction device according to the present invention.
Figure 6:
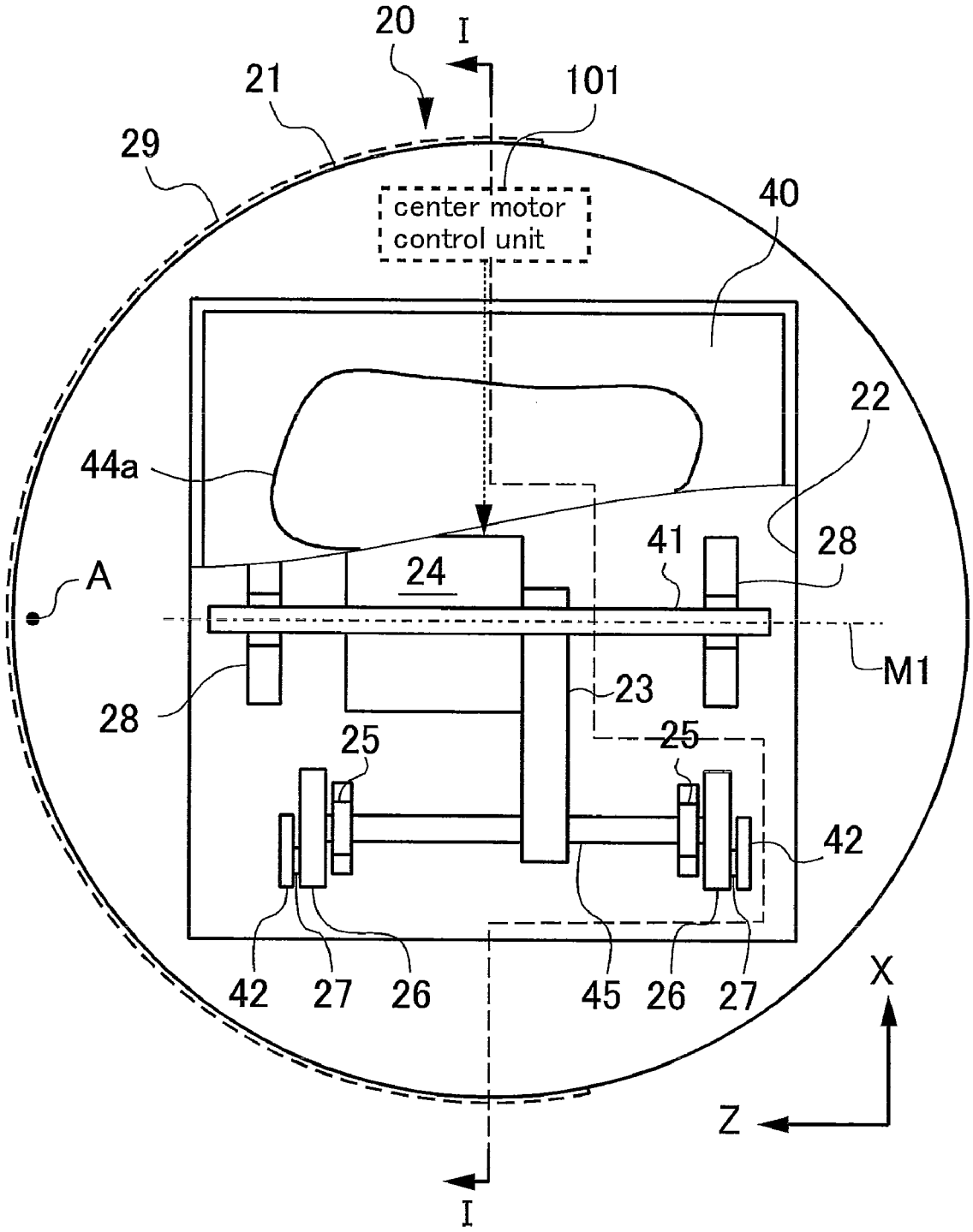
FIG. 6 is an upper view of the main section of a spinal correction device according to the present invention.

With reference to FIG. 4 to FIG. 6, the lower limb exercising part 20 is provided to a center housing 21 of a substantially cylindrical shape. A rack gear 29 that continues across substantially half the periphery toward the outer periphery side is provided to the center housing 21, and at least three legs 70 that contact the floor are provided to a base 21*a*. The center housing 21 comprises an opening 22 of a substantially rectangular shape on the ceiling thereof, and is provided in such a manner that the footboard 40 protrudes from the inside to the outside of the center housing 21, thereby blocking opening 22. The footboard 40 is an integrally molded member of a substantially dish-like shape having a bending part 40*a* along the periphery of a rectangular metal plate. The back surface of the footboard 40 is provided with two rotating shaft installation members 40*b* spaced apart in relation to the direction along a center axis M1 parallel to the Z axis. Each of the rotating shaft installation members 40*b* has a through-hole 40*b*' along the center axis M1. Two bearings 28 are provided to the center housing 21, spaced apart in relation to the direction along the center axis M1. A shaft 41 is inserted through each of the through-holes 40*b*' of the two rotating shaft installation members 40*b* of the footboard 40, and is rotatably supported by a concave part 28' provided to the upper part of the bearings 28. With this arrangement, the footboard 40 freely swings about the shaft 41 arranged along the center axis M1. Foot placement area 44*a* and 44*b*, each marked with a sole shape illustrating the position where the lower limbs of the user should be positioned, are symmetrically provided on the external surface of the footboard 40 with respect to the center axis M1. Two connecting rod installation members 40' are installed to internal surface of the footboard 40, offset by a predetermined distance from the center axis M1 in the −X direction.

With reference to FIG. 6, a shaft 45 along the Z axis is rotatably supported by a stay 25 installed to the center housing 21, and a crank circular plate 26 is fixed to both ends thereof. One end of a connecting rod 42 is rotatably connected by a pin 27 to a position offset from the rotational axis of the crank circular plate 26 in the outer periphery direction, and the other end of the connecting rod 42 is connected to the connecting rod installation member 40' (refer to FIG. 5). The crank circular plate 26 is connected to a power transmitting unit 23 comprising a gear, pulley, and the like via the shaft 45, and the power transmitting unit 23 is connected to a central driving unit 24 that includes a motor and the like. The central driving unit 24 is capable of controlling the driving speed, etc., by a center motor control unit 101.

When the motor inside the central driving unit 24 is activated causing the crank circular plate 26 to rotate via the connected power transmitting unit 23, the connecting rod 42 reciprocates the connecting rod installation member 40' up and down with the shaft 41 having the center axis M1 as the fulcrum point. With this arrangement, the footboard 40 moves in a seesaw motion with the shaft 41 as the axis of rotation. In the vicinity of the foot placement area 44*a* and 44*b* of the above-described footboard 40, the stroke by which the underside surfaces of both feet of the user are moved up and down, is preferably 3 cm or less, more preferably 2 cm or less, which is an amount that is not too excessive for imparting oscillation to the spinal column.

As illustrated in FIG. 4, a collar 71 that protrudes toward the outer peripheral side is provided on the bottom outer periphery of the lower limb exercising part 20. The upper surface of the collar 71 is smoothly polished and comes in contact with roller groups 72. At least three roller groups 72 are arranged in the lower end inner side section of the rotating part 30 so that the rotating part 30 freely rotates with respect to the lower limb exercising part 20.

Figure 7:
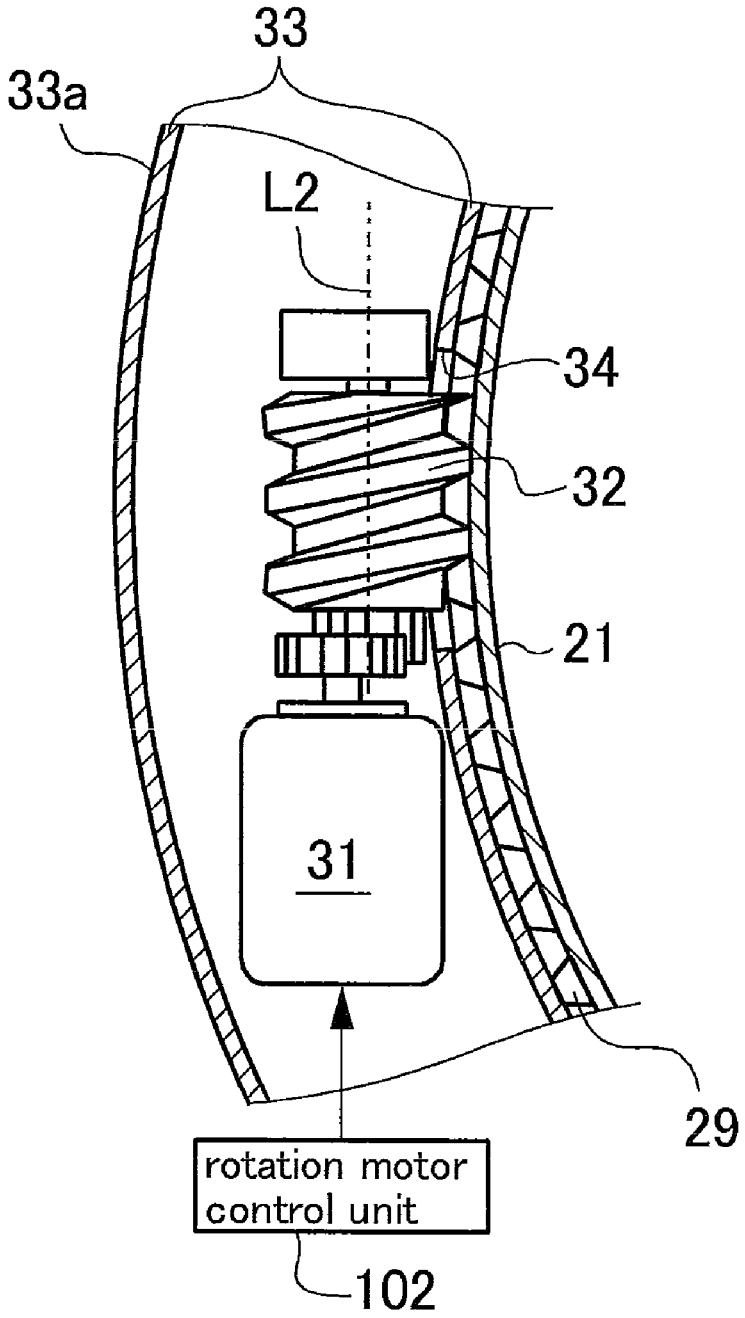
FIG. 7 is a cross-sectional view (cross-section II-II) of the main section of a spinal correction device according to the present invention.

With reference to FIG. 7, a rotation driving part 31 that includes a gear, motor, and the like, and is capable of controlling the driving speed, etc., via a rotation motor control unit 102 is fixed to the inside of a rotation housing 33 that defines the rotating part 30. The rotation driving part 31 is connected to a worm gear 32 comprising a rotational axis L2 perpendicular to the rotational axis of the rotating part 30. The worm gear 32 engages with the rack gear 29 provided across approximately half the periphery of the outer periphery of the center housing 21, via a window 34 provided on the inner peripheral side of the rotation housing 33. When the worm gear 32 is rotated by the rotation driving part 31, the rotating part 30 rotates the outer periphery of the lower limb exercising part 20 up to approximately 90 degrees horizontally with respect to the reference point A (refer to FIG. 3).

Figure 8:
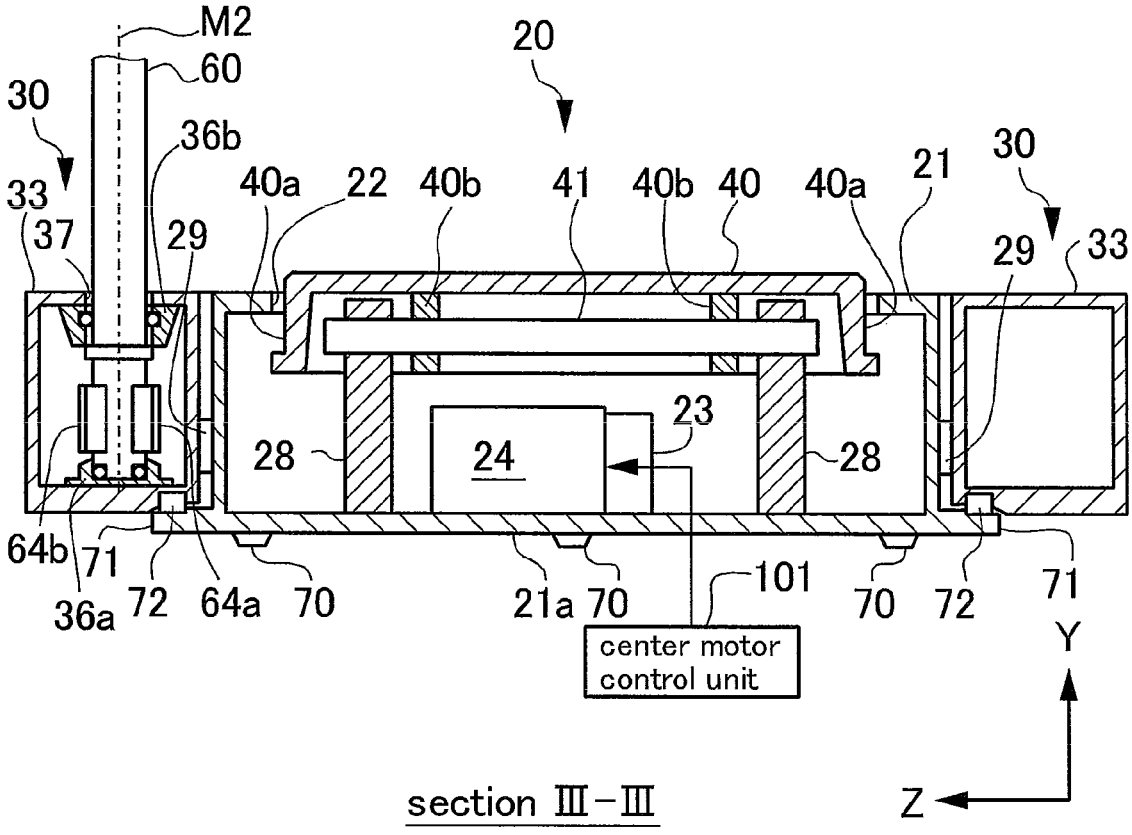
FIG. 8 is a cross-sectional view (cross-section III-III) of the main section of a spinal correction device according to the present invention.
Figure 9:
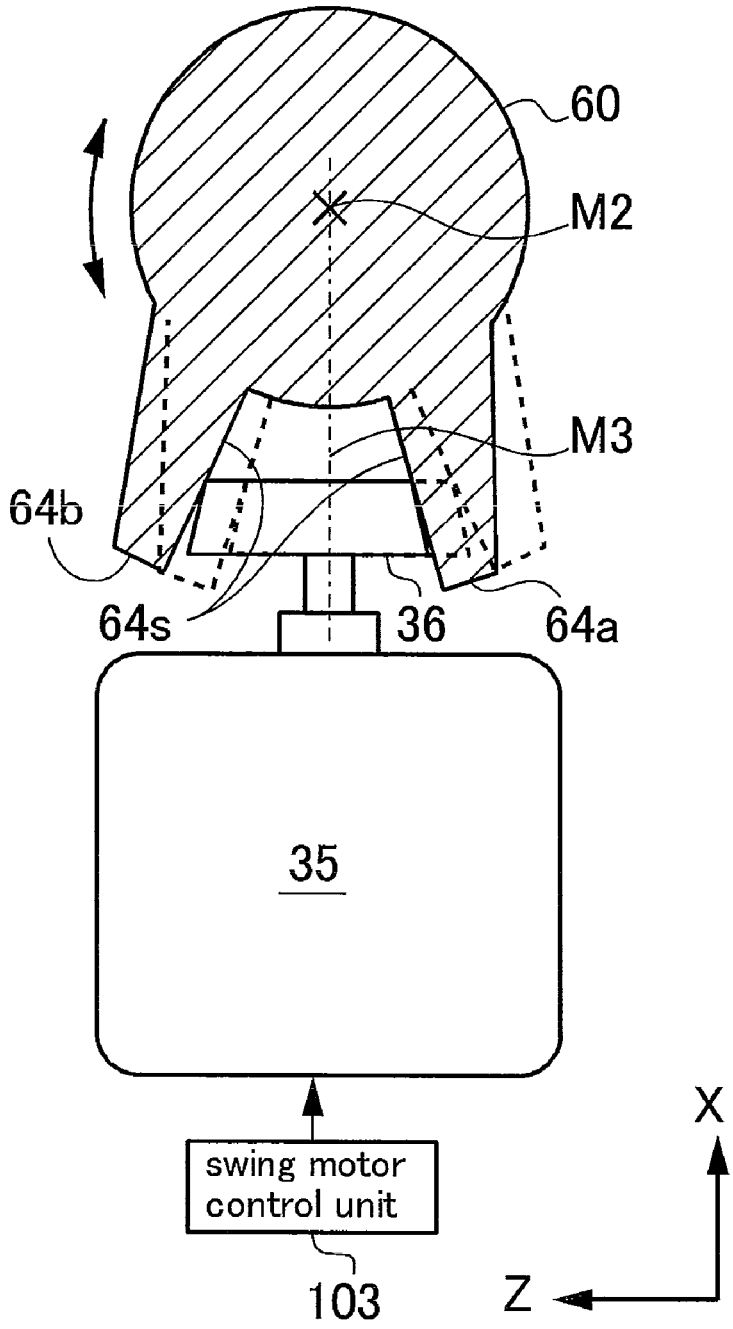
FIG. 9 is an upper view of the main section of a spinal correction device according to the present invention.

With reference to FIG. 3, FIG. 8, and FIG. 9, in the vicinity of the reference point A of the rotating part 30, a through-hole 37 is provided on the ceiling surface of the rotation housing 33. The hollow rotating pillar 60 is inserted through the through-hole 37, and the lower end thereof is rotatably supported about a rotational axis M2 parallel to the Y axis by bearings 36*a* and 36*b* provided to the bottom surface and ceiling surface back side in the interior of the rotation housing 33. Fin members 64*a* and 64*b* that protrude in the −X direction are joined at the bottom end of the rotating pillar 60 positioned within the rotation housing 33. The fin members 64*a* and 64*b* are spaced apart from each other and connected to the rotating pillar 60 so that opposing surfaces 64*s* thereof become parallel to the rotational axis M2. A cam 36 is provided between the fin members 64*a* and 64*b* and comes in contact with the fin members 64*a* and 64*b* The cam 36 has a cam rotational axis M3 perpendicular to the rotational axis M2. The cam 36 is a circular plate eccentrically positioned with respect to the cam rotational axis M3, and is connected to a swing driving part 35 that includes a gear, motor, and the like. The swing driving part 35 is capable of controlling the driving speed, etc., by a swing motor control unit 103.

When the swing driving part 35 is activated to rotate the cam 36, the fin members 64*a* and 64*b* reciprocate according to the rotation of the cam 36 and, in turn, the rotating pillar 60 repeats a reciprocating motion around the rotational axis M2. With this arrangement, the handle 50 engaged at the upper part of the rotating pillar 60 swings within the plane X-Z, about the rotational axis M2. The back and forth stroke in the vicinity of the gripping parts 51*a* and 51*b* of the handle 50 is preferably 8 cm or less.

Figure 10:
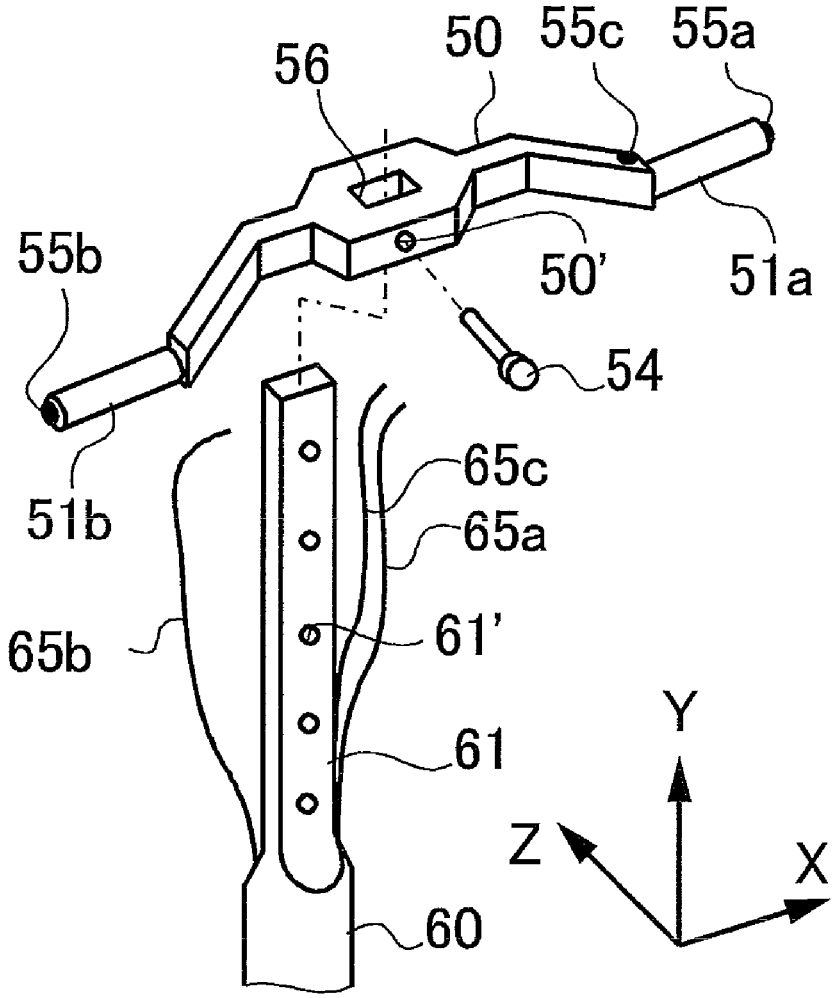
FIG. 10 is an exploded perspective view of the main section of a spinal correction device according to the present invention.

With reference to FIG. 3 and FIG. 10, on the upper part of the rotating pillar 60 are formed the engaging part 61 having a substantially rectangular cross-sectional shape, and a plurality of height adjustment holes 61' spaced apart from each other in relation to the Y axial direction. An engaging hole 56 of the handle 50 is engaged to the engaging part 61. Then, the handle 50 is fixed by communicating a through-hole 50' provided at the center of the handle 50 with one of the height adjustment holes 61' and inserting a pin 54 through that communicated hole. With this configuration, the height of the handle 50 is adjustable. A mechanism to prevent pin 54 from dropping is preferably provided to pin 54. Gripping parts 51*a* and 51*b* are provided to both ends of the handle 50, and rotation switches 55*a* and 55*b* are provided to each end thereof. Further, a swing switch 55*c* is provided on the inner side of the gripping part 51*a*. The rotation switches 55*a* and 55*b* and the swing switch 55*c* are respectively connected to wires 65*a*, 65*b*, and 65*c* via wiring within the handle (not shown), and the wires 65*a*, 65*b*, and 65*c* are connected to a central control unit 100, described later, through the interior of the hollow rotating pillar 60.

Figure 11:
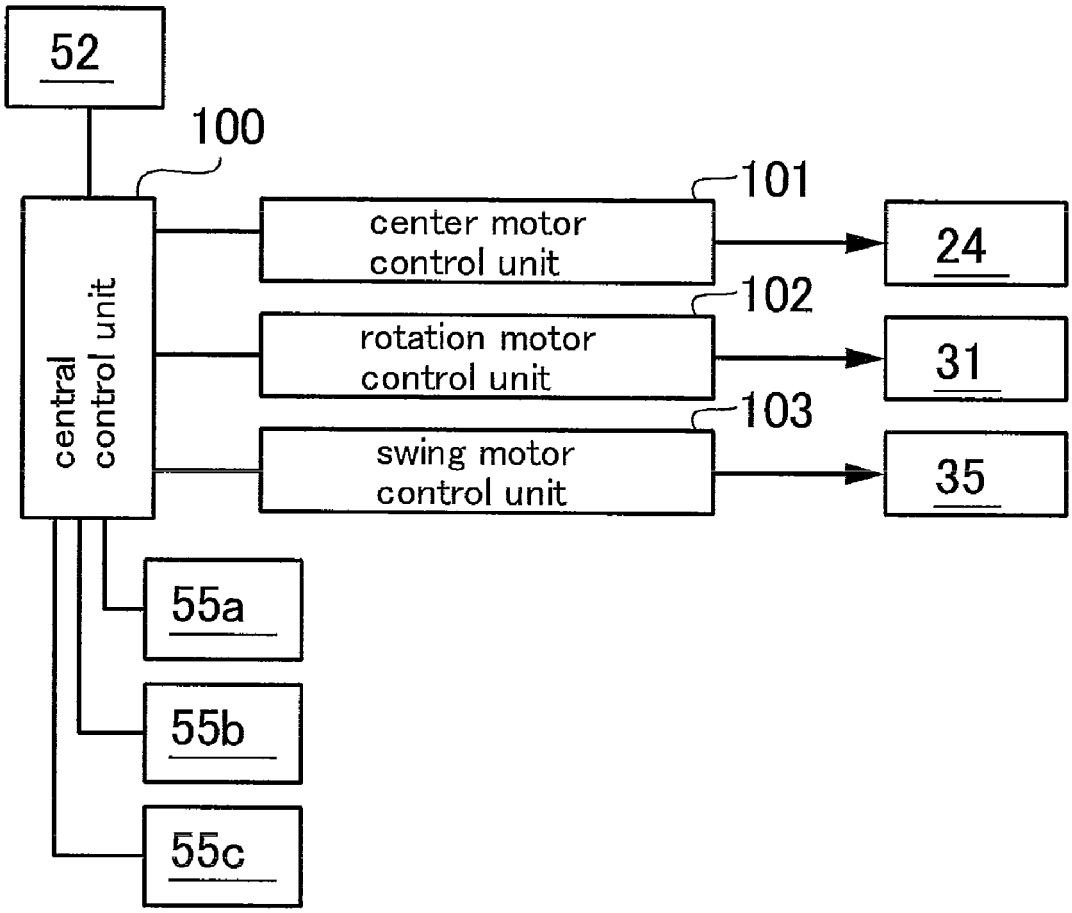
FIG. 11 is a control diagram of a spinal correction device according to the present invention.

With reference to FIG. 11, which is a control diagram of the spinal correction device according to the present invention, the operation unit 52, the rotation switches 55*a* and 55*b*, and the swing switch 55*c* are connected to the central control unit 100. The center motor control unit 101, the rotation motor control unit 102, and the swing motor control unit 103 are connected to the central control unit 100. When the operation unit 52, the rotation switches 55*a* and 55*b*, and the swing switch 55*c* are operated, an operation signal is sent to each control unit from the central control unit 100, thereby controlling the central driving unit 24 that moves the footboard 40 in a seesaw motion, the rotation driving part 31 that rotates the rotating part 30, and the swing driving part 35 that swings the handle 50.

Next, the method of use and the operation of the spinal correction device 10 will be described in detail with reference FIG. 3 to FIG. 11.

In a case where an area exists in which the contractile force has decreased in the transversospinal muscles, the person unintentionally protects that area when twisting the upper half of the body, causing the twist angle of the upper half of the body to become shallower. Thus, the user first twists his or her upper half of the body left and right while standing or sitting without moving the lumber region to check which of the left or right twist direction has a shallower twistable angle. Then, using the spinal correction device 10, the user imparts twist to the side that has the shallower twist angle when he or she had twisted the upper half of the body, thereby imparting a swing to the lumbar region and stretching the transversospinal muscle having the decreased contractile force.

With reference to FIG. 3, first, the user places the soles of his or her feet on the foot placement area 44*a* and 44*b* each marked with a sole shape, and stands facing the reference point A. The user then grips the handle 50 in a pronated or supinated position with his or her forearms substantially horizontal, and adjusts the height of the handle 50 from the chest region to near the abdomen region so that the positional relationship with the user's shoulders does not significantly change when the handle 50 moves. Here, the pronated position refers to the orientation of the wrist joint with respect to the elbow joint when the thumb is positioned to the inside and the palm is facing downward. The supinated position refers to the orientation of the wrist joint with respect to the elbow joint when the thumb is positioned to the outside and the palm is facing upward. And, the intermediate position refers to the orientation of the wrist joint with respect to the elbow joint when the thumb is positioned upward and the palm is facing sideways.

Next, the user operates the operation unit 52 to adjust the angular velocity for rotating the rotating part 30. This angular velocity is also the velocity at which twist is imparted to the trunk and spinal column, and is therefore preferably adjusted within the range of 5 to 45 degrees per second so that the body of the user is not adversely affected.

Next, the user determines the frequency at which the footboard 40 of the lower limb exercising part 20 is to move in a seesaw motion. Such a frequency is the frequency required for short, quick oscillation of the vertebrae that constitute the spinal column, and can be arbitrarily defined within the range of 2 to 22 Hz. The user inputs the determined frequency value into the operation unit 52 to start the lower limb exercising part 20 at the predetermined frequency. Specifically, with reference to FIG. 3, FIG. 4, and FIG. 11, the user operates the operation unit 52, thereby supplying power from the central control unit 100 to the central driving unit 24 via the center motor control unit 101. The user can change the rotational speed of the motor (not shown) after startup as well by operating the operation unit 52. The driving force achieved by the central driving unit 24 rotates the crank circular plate 26 via the power transmitting unit 23. The rotation of the crank circular plate 26 is converted to motion that moves the X-axial end part of the footboard 40 vertically with the center axis M1 as the fulcrum point, by the connecting rod 42. That is, the footboard 40 moves in a seesaw motion with the center axis M1 as the fulcrum point. Since the foot placement area 44*a* and 44*b* are symmetrically located with respect to the center axis M1, they move in tandem in mutually opposite phases.

With the center axis M1 of the seesaw motion of the footboard 40 disposed so that it comes between the lower limbs of the user, vertical motion is imparted in opposite phases from the lower limbs to pelvis positions that are horizontally symmetrical with respect to the spinal column, according to the movement of the foot placement areas 44*a* and 44*b*. With vertical motion of opposite phases thus imparted to the lower limb left and right, the connecting position of the spinal column and pelvis becomes positioned at the substantial center of the swing of the pelvis, causing short, quick oscillation to be transmitted to the vertebrae. Further, the user who is standing is forced to maintain his or her posture with the lumber region facing the reference point A in order to keep his or her balance as the seesaw motion of the footboard 40 is introduced. Note that the preferred frequency of the seesaw motion of the footboard 40 is 2 to 22 Hz.

Descriptions of the method of use and the operation of the spinal correction device 10 will now continue with reference to FIG. 7, FIG. 10, and FIG. 11. The user grips each of the gripping parts 51*a* and 51*b* of the handle 50 in a supinated position.

The user operates the rotation switch 55*a* or 55*b* with his or her thumb to rotate the rotating part 30. That is, when the user presses the rotation switch 55*a* with his or her right-hand thumb, power is supplied to the rotation driving part 31 via the rotation motor control unit 102 by a signal from the central control unit 100. The frequency of the motor of the rotation driving part 31 is controlled by the rotation motor control unit 102 so that the angular velocity adjusted using the operation unit 52 is imparted to the rotating part 30. When the user presses the rotation switch 55*a*, the handle 50 rotates to the left, moving leftward with respect to the reference point A. When the user releases the rotation switch 55*a*, the rotation stops (or, the rotation is switched to the opposite direction when settings are changed as described later). Based on a similar operation, when the user operates the rotation switch 55*b*, the rotating part 30 is rotated to the right. Here, when the rotating part 30 is rotated to the left or right side having the shallower twist angle verified in advance, the chest and shoulders of the user gripping the gripping parts 51*a* and 51*b* are twisted by the rotation of the rotating part 30. That is, the shoulders are turned with respect to the spinal column 1. Thus, the spinal column 1 above the lumbar region of the user who has maintained his or her posture with the lumbar region facing the reference point A is twisted.

When the user grips the gripping parts 51*a* and 51*b* in a supinated position, the underarm region of the upper limbs tightens, stabilizing the position of the trunk. With this arrangement, the oscillation is sufficiently absorbed in the section where spinal distortion has occurred, causing the transversospinal muscle related to that section to repeatedly shift from a stretched state to an even further stretched state. Further, the underarms of the user effectively transmit the motion of the handle 50 to the shoulder region, thereby decreasing the "play of movement" of the chest and shoulders of the user, eventually imparting a twist to the spinal column 1 itself. The user stops the rotation of the rotating part 30 before he or she feels pain around the periphery of the shoulders and the spinal column 1. As described above, the lumbar region of the user imparts a twist to the spinal column 1 between the lumbar region and the shoulder region, without imparting a twist to the lower limbs.

With the twisting of the spinal column 1, the transversospinal muscle (refer to FIG. 1) of the erector spinal column segment is stretched in accordance with the distortion of the spinal column. Then, motion is imparted to symmetrical positions on each side of the spinal column of the user to swing the lumbar region, thereby stabilizing the position of the lumbar region and transmitting short, quick oscillation to the vertebrae of the spinal column. Particularly, this oscillation is absorbed in the section where spinal distortion has occurred, causing the transversospinal muscle related to that section to repeatedly shift from a stretched state to an even further stretched state. That is, with the device, it is possible to simply correct a spinal column in which distortion has occurred without requiring precise adjustment of the relative positional relationship of the user and the spinal correction device. According to such an invention, a mechanism for positioning the user to the spinal correction device is not needed, making it possible to achieve a device that is small in size and easily assembled.

In this embodiment, even if an attempt is made to rotate the rotating part 30 and temporarily exceed the twisting threshold of the body of the user, the right hand of the user is released from the rotation switch 55*a* in a case where the user is rotating to the left, for example, immediately stopping the rotation.

Next, another method of use and the operation of the spinal correction device 10 will be suitably described with reference to FIG. 3 to FIG. 11. The method of use described here imparts motion from the handle 50 to the user.

With reference to FIG. 3, the user adjusts the height of the handle 50 of the spinal correction device 10 and the angular velocity by which the rotating part 30 rotates. Next, the user determines the frequency at which the footboard 40 of the lower limb exercising part 20 is to move in a seesaw motion. Such a frequency is the frequency required for short quick oscillation of the vertebrae that constitute the spinal column, and is arbitrarily defined within the range of 2 to 22 Hz. After determining the frequency, the user inputs the frequency value into the operation unit 52. Furthermore, the user determines the frequency by which the handle 50 is to oscillate within the range of 2 to 22 Hz and inputs this frequency value into the operation unit 52.

Next, the user operates the operation unit 52 to start the footboard 40 of the lower limb exercising part 20 at the predetermined frequency.

Subsequently, the user starts the handle 50 at the predetermined frequency and grips the gripping parts 51*a* and 51*b* of the handle 50 in a supinated position. Specifically, with reference to FIG. 9 to FIG. 11, the user presses the swing switch 55*c* to supply power to the swing driving part 35 via the swing motor control unit 103 from the central control unit 100, which causes the swing driving part 35 to rotate the cam 36. The rotating cam 36 reciprocates the opposing surfaces 64*s* of the fin members 64*a* and 64*b* arranged on the bottom end of the rotating pillar 60 in the Z axial direction. As a result, the rotating pillar 60 of FIG. 9 alternately rotates in the clockwise direction and counterclockwise direction at a predetermined angle with the rotational axis M2 as the fulcrum point, thereby repeatedly swinging the handle 50 engaged to the upper part of the rotating pillar 60 within the horizontal plane (XZ plane), with the rotational axis M2 as the fulcrum point.

Furthermore, as described above, the user operates the rotation switch 55*a* or 55*b* to rotate the rotating part 30 in a desired direction with respect to the lower limb exercising part 20, imparting twist to the spinal column 1.

Due to the swing of the handle 50, a motion that moves the left and right upper limbs of the user back and forth in opposite phases is already imparted. With such a swing, before the rotation of the rotating part 30 imparts twist to the spinal column 1, the left and right shoulder regions of the user are swung back and forth in opposite phases, defining the center axis of the twist of the spinal column along the longitudinal direction of the spinal column and stabilizing the posture of the user. Note that to achieve this stabilized posture, the swing frequency of the handle 50 is preferably 2 to 22 Hz.

In the above-described operation, when the frequencies of the seesaw motion of the footboard 40 and the swing of the handle 50 are made to match, the above-described center axis of the twist of the spinal column 1 is readily defined. Particularly, when the frequencies of the seesaw motion of the footboard 40 and the swing of the handle 50 are made to match and the phases are adjusted so that the gripping part 51*b* is closest to the user when the foot placement area 44*b* is highest, the positional relationship between the lumbar region and shoulder region substantially matches the positional relationship between the lumbar region and shoulder region when walking, and the center axis of the twist of the spinal column 1 is readily defined.

It should be noted that the rotation switches 55*a* and 55*b* may be provided on the inside of the gripping parts so that the switches are operable even when the gripping parts 51*a* and 51*b* are gripped in pronated positions.

Further, while in this embodiment the lower limb exercising part 20 is fixed to the base and the rotating part 30 is rotated around the periphery of the lower limb exercising part 20, the structure may be opposite, allowing the rotating part 30 to be fixed to the base and the lower limb exercising part 20 to be rotated.

Rotation may also be controlled so that, when the user presses the rotation switch 55*a* or 55*b* to rotate the rotating part 30 and then releases his or her hand from that switch, the rotating part 30 is immediately reversed. Such control corrects the distortion of the spinal column 1 while alleviating the burden of the user when in the vicinity of the threshold of the twist of the body of the user.

Further, while not shown, the shaft 41 may be provided parallel to the X axis to move both Z-axial ends of the footboard 40 vertically in opposite phases. That is, with the user axis that extends in the horizontal direction arranged directly beneath the spinal column so that the underside surfaces of the feet of the lower limbs of the user are caused to incline backwards and forwards, vertical motion of respectively opposite phases is imparted to anteroposterior symmetrical positions of the pelvis with respect to the spinal column. At the same time, the lumbar region of the user swings back and forth in an attempt to keep his or her balance and maintain an erected posture. Along with the swing performed when the user attempts to balance in a standing position, short quick oscillation is transmitted to the vertebrae. As a result, a repeated motion of shifting from a stretched position to an even further stretched position is imparted to the transversospinal muscle with decreased contractile force, which activates the contractile force decreased in the transversospinal muscle, resulting in the distortion of the spinal column 1 being corrected by the contractile force thus restored.

Figure 13A:
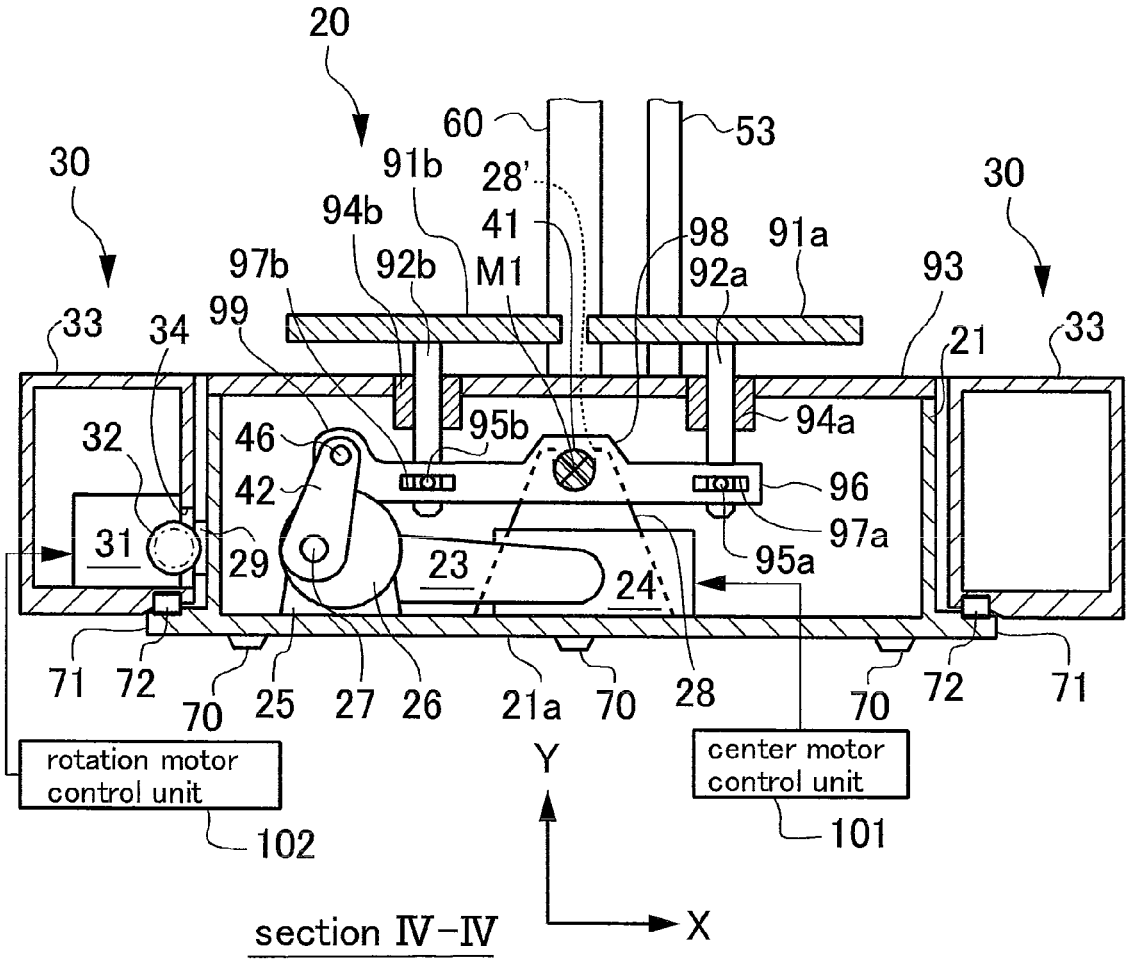
FIG. 13A is a cross-sectional view (cross-section IV-IV) of the main section of a spinal correction device according to the present invention.
Figure 13B:
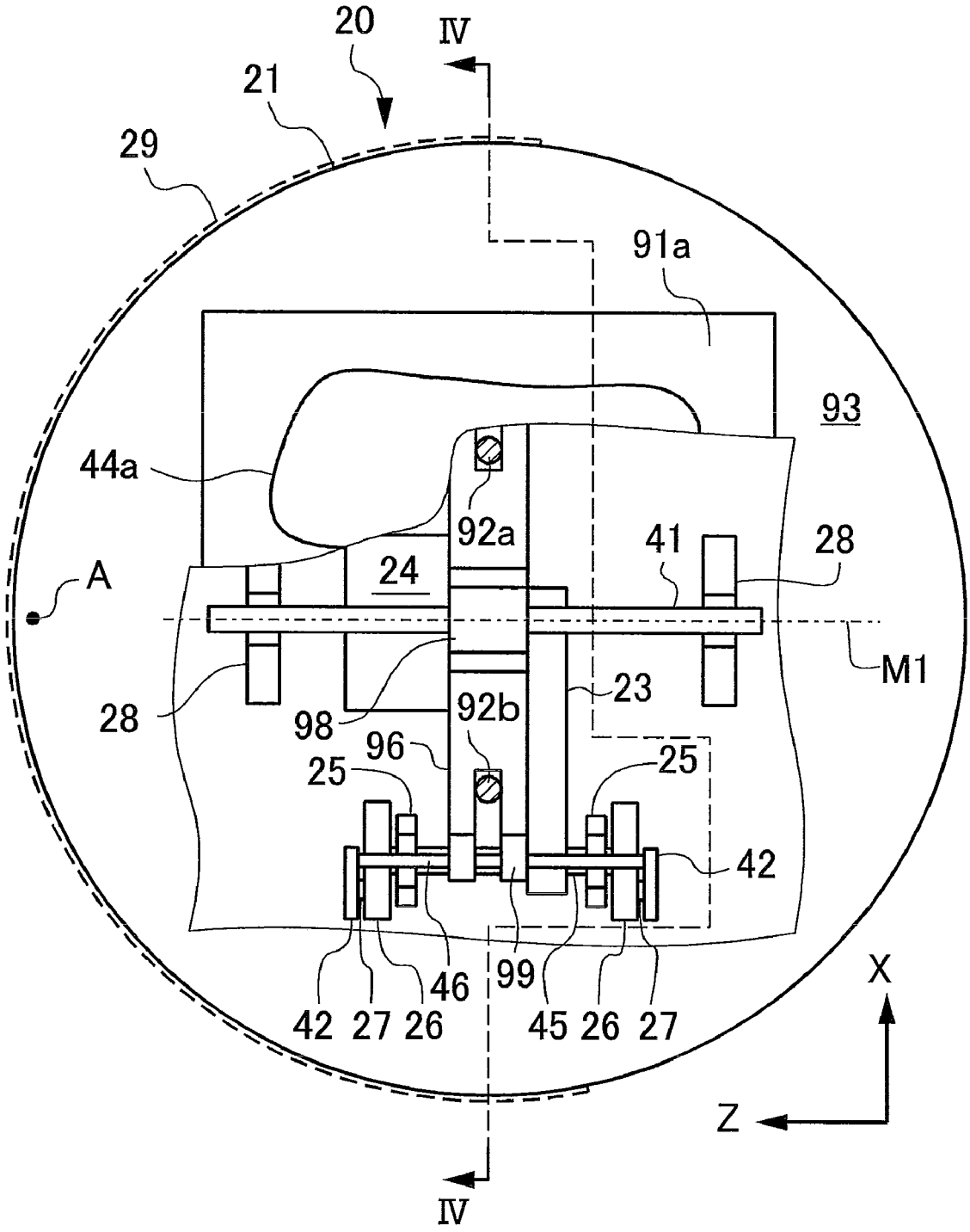
FIG. 13B is an upper view of the main section of a spinal correction device according to the present invention.

Note that, as illustrated in FIG. 13A and FIG. 13B, a pair of footboards 91*a* and 91*b* provided in opposition in the X axial direction with the reference point A therebetween may be utilized in place of the footboard 40.

Similar to the embodiment in which the footboard 40 is mounted (refer to FIG. 6), the central driving unit 24 controlled by the center motor control unit 101, which is capable of controlling the driving speed, is provided in this embodiment as well. The central driving unit 24 includes a motor and transmits power generated thereby to the shaft 45 via the power transmitting unit 23 comprising a gear, pulley, and the like. The shaft 45 is provided along the Z axis, rotates around a rotational axis parallel to the Z axis, and is supported at both ends by the stay 25. The pair of crank circular plates 26 that share a rotational axis with the shaft 45 is arranged on both ends of the shaft 45. An insertion through-hole having threads cut in the Z axial direction is provided on each crank circular plate 26 at a position having an identical amount of offset in the identical outer peripheral direction from that rotational axis. One end of the same connecting rod 42 having an insertion through-hole on the ends thereof is installed in each of the insertion through-holes by the pin 27. The pin 27 thus installed in the insertion through-hole rotates inside that insertion through-hole. A connecting shaft 45 is installed in the insertion through-hole of the other end of each connecting rod 42 so that it rotates inside that insertion through hole, and is connected to both connecting rods 42. The center of the connecting shaft 46 is connected with a connecting rod installation part 99 provided to one end of a swinging body 96 that forms a substantially bar shape extending in the X axial direction, so that the swinging body 96 swings about the center axis M1 when the connecting shaft 46 moves up and down in association with the rotation of the crank circular plate 26.

Note that the central driving unit 24, the power transmitting unit 23, the shaft 45, the crank circular plate 26, and the connecting rod 42 are the same members as those in the embodiment with the footboard 40 mounted.

As illustrated in FIG. 13B, the swinging body 96 is provided with a slit along the XY plane at the center part of both ends thereof. This slit is provided at a location that is about one-third the distance between the end part and the center axis M1 from the end part, facing the center axis M1. A long through-hole 97*b* that passes through this slit in the Z axial direction and extends in the longitudinal direction (X axial direction) of the swinging body 96 is provided on the side wall of one end side of the swinging body 96 across from the slit. Further, the swinging body 96 comprises a rotating shaft installation part 98 comprising a through-hole at the substantial center thereof, and the shaft 41 is inserted through that through-hole in the Z axial direction. The shaft 41 is supported at both ends by the two bearings 28 so that the swinging body 96 swings with the center axis M1 as the fulcrum point.

On the other hand, the upper end of a slide shaft 92*b* that extends in the perpendicular direction is fixed to the bottom surface of the footboard 91*b*. The slide shaft 92*b* passes through a tubular member 94*b* that passes through a top cover 93 that blocks the upper part of the center housing 21. An insertion through-hole is provided in the Z axial direction at the bottom end of the slide shaft 92*b*.

A pin 95*b* that communicates in the Z axial direction is inserted through the insertion through-hole at the bottom end of the slide shaft 92*b* and the slide through-hole 97*b* of the above-described swinging body 96 so that the swinging motion of the swinging body 96 having the center axis M1 as the fulcrum point is converted to a vertical motion of the slide shaft 92*b*.

Similarly, a pin 95*a* is inserted through the through-hole at the bottom end of a slide shaft 92*a*, connecting the slide shaft 92*a* with the other end of the swinging body 96 so that the swinging motion of the swinging body 96 having the center axis M1 as the fulcrum point is converted to a vertical motion of the slide shaft 92*a*.

The footboards 91*a* and 91*b* reciprocate in opposite phases in the vertical direction. Vertical motion is imparted to the pelvis of the user having both underside surfaces of the feet positioned on the footboards 91*a* and 91*b* at horizontally symmetrical positions with respect to the spinal column, through the left and right lower limbs. Independent of the distance between the right foot and left foot, a predetermined stroke is accurately achieved. Such a stroke is preferably 2 cm or less.

The footboards 91*a* and 91*b* may be configured so that vertical motion is imparted to the left and right separately by a cam mechanism (not shown). For example, a vertical reciprocating motion may be imparted to the footboard 91*b* while the footboard 91*a* is static, and imparted to the footboard 91*a* while the footboard 91*b* is subsequently static.

It is preferable to provide foot fixing means to the footboard 40 or the footboards 91*a* and 91*b*, which employs a hook-and-loop fastener, rubber or the like, and applies pressure to the dorsum of the foot of the user to enable the underside surfaces of the feet to press against the footboard (s).

Figure 12:
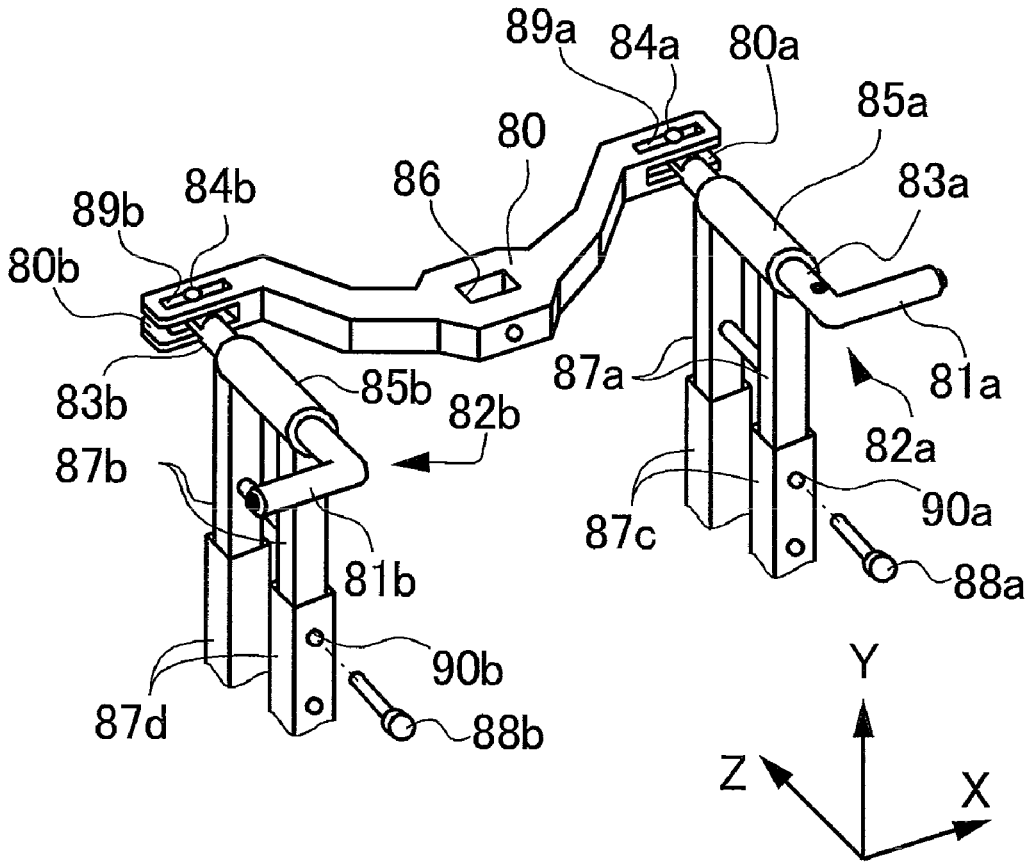
FIG. 12 is a perspective view of the main section of a spinal correction device according to the present invention.

Furthermore, a handle 80 illustrated in FIG. 12 may be used in place of the handle 50 illustrated in FIG. 3. The handle 80 comprises an engaging hole 86 of a substantially rectangular shape at the center thereof. The engaging part 61 (refer to FIG. 10) of the upper part of the rotating pillar 60 engages with the engaging hole 86. Slits 80*a* and 80*b* are cut horizontally, and vertically opposing slide holes 89*a* and 89*b* are provided on both ends of the handle 80. One end of each gripping body 82*a* and 82*b* is inserted through the slits 80*a* and 80*b*. On the other hand, pins 84*a* and 84*b* inserted in these ends are slidably engaged inside the slide holes 89*a* and 89*b*. The L-shaped gripping bodies 82*a* and 82*b* comprise slide parts 83*a* and 83*b* that extend in the −Z axial direction from the end where the pins 84*a* and 84*b* are inserted, and gripping parts 81*a* and 81*b* that are parallel to the X axis and respectively bend in directions away from each other. The slide parts 83*a* and 83*b* are slidably inserted inside tubular members 85*a* and 85*b*. In a state where the rotating pillar 60 is closest to the reference point A, the tubular members 85*a* and 85*b* are fixed to the upper ends of upper fixed pillars 87*a* and 87*b* so that the longitudinal direction thereof is parallel with the Z axis. The upper fixed pillars 87*a* and 87*b* are inserted through one end of bottom fixed pillars 87*a* and 87*d* provided orthogonal to the rotating part 30, and installed so as to freely slide vertically.

The upper fixed pillars 87*a* and 87*b* have adjustable heights with respect to lower fixed pillars 87*c* and 87*d* by means of height adjusting pins 88*a* and 88*b* and height adjusting holes 90*a* and 90*b*, and one end of each of the gripping bodies 82*a* and 82*b* is inserted into the slits 80*a* and 80*b* of the handle 80.

With such a configuration, back and forth linear motion is imparted in horizontally opposite phases to the left and right upper limbs of the user gripping the gripping parts 81*a* and 81*b*. Even in a case where such the handle 80 is used, the center axis of the twist of the spinal column 1 is defined in the same manner as the above-described handle 50.

According to the above embodiment of the present invention, twist is imparted to the spinal column 1 of the user, thereby imparting a repeated motion of shifting between a stretched state and an even further stretched state to the transversospinal muscle with decreased contractile force, activating the contractile force decreased in the transversospinal muscle. After the twist of the spinal column 1 is resolved, the distortion of the spinal column 1 is corrected by the contractile force activated by the transversospinal muscle.

A modification of the above-described spinal correction device will now be described in detail with reference to FIG. 14 to FIG. 27.

Figure 14:
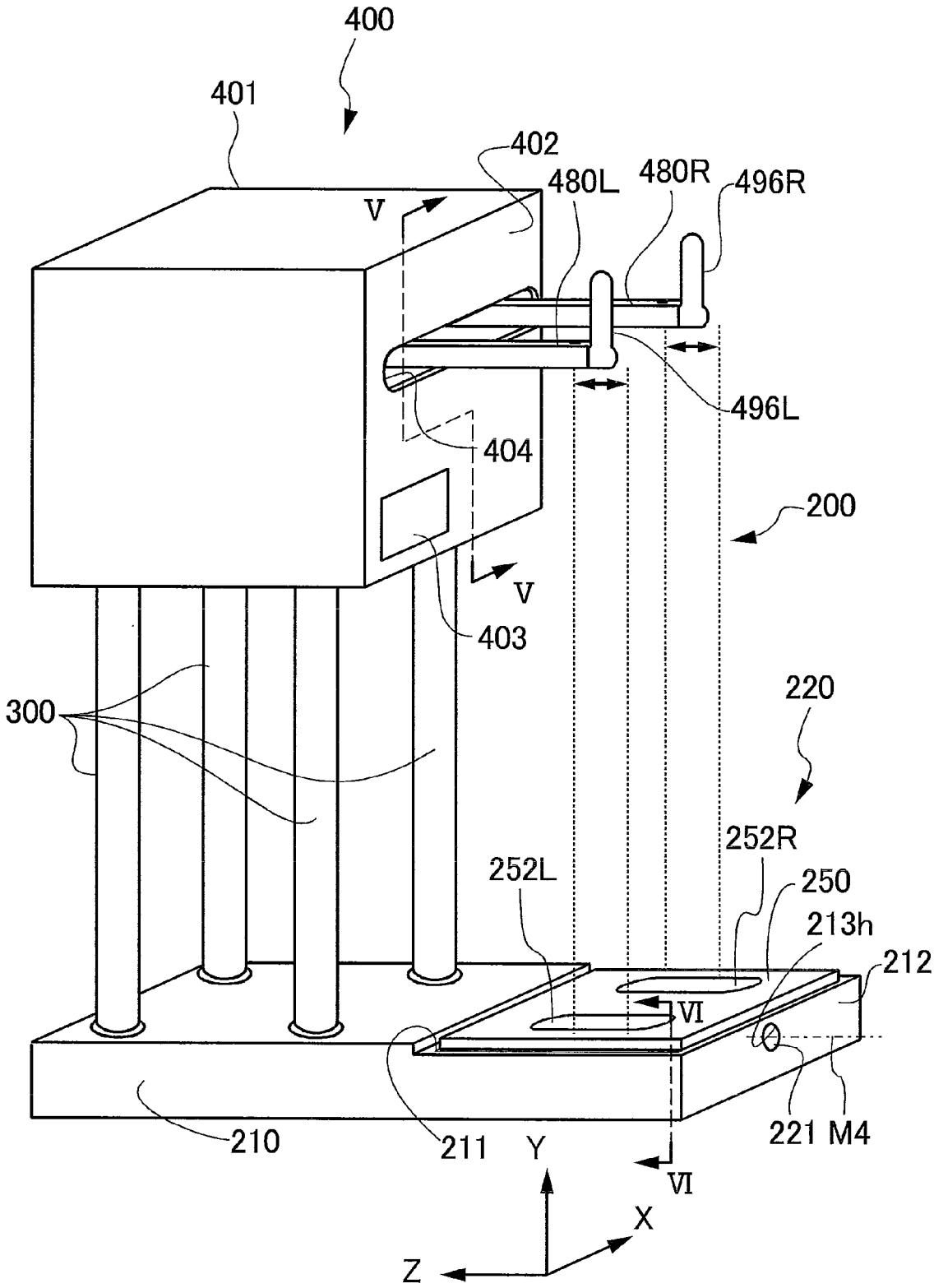
FIG. 14 is a perspective view of a modification of a spinal correction device according to the present invention.

As illustrated in FIG. 14, a spinal correction device 200 comprises a lower limb exercising part 220 provided to one side of a housing 210, four pillars 300 that are provided to the other side of the housing 210 and extend in the perpendicular direction (+Y), and an upper limb exercising part 400 arranged on the upper end of the group of pillars 300. Note that in the following, the X axis, Y axis, and Z axis are defined as illustrated in FIG. 14. That is, facing the spinal correction device 200, the +X direction is rightward, the +Y direction is upward, and the +Z direction is frontward.

First, the configuration of the lower limb exercising part 220 will be described with reference to FIG. 14 to FIG. 17. The lower limb exercising part 220 comprises a driving unit 230 and a power transmitting unit 240 provided inside the housing 210, and a footboard 250, and the driving unit 230 provided on the bottom surface of the housing 210 includes a motor that controls the driving speed and the like by a lower motor control unit 511, transmitting power to the power transmitting unit 240 arranged nearby. The power transmitting unit 240 comprises a gear, pulley, and the like, and transmits power to the footboard 250.

Figure 16:
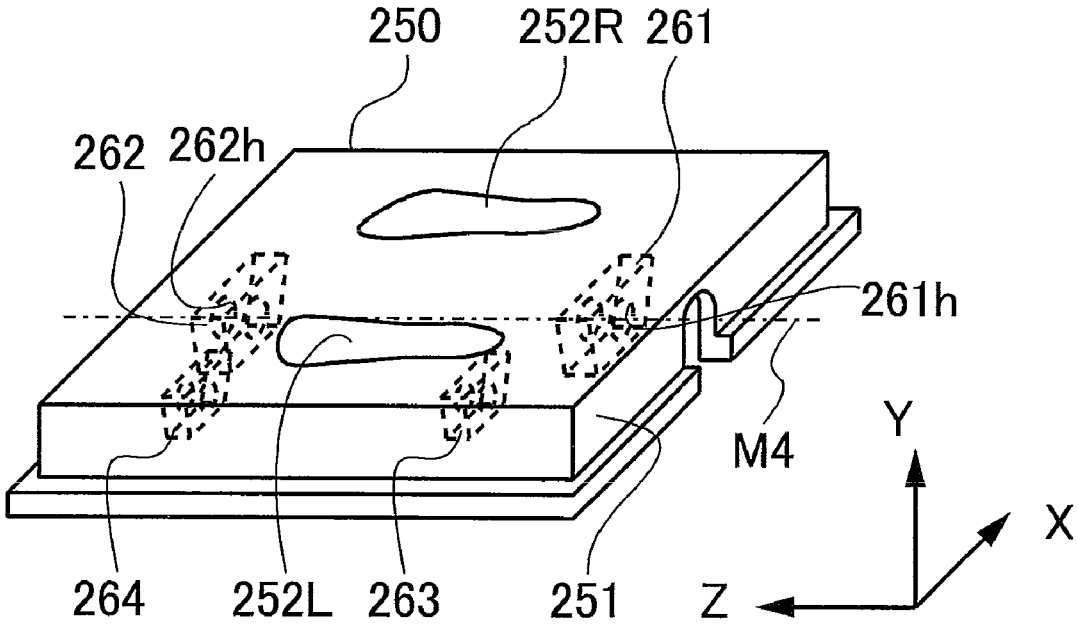
FIG. 16 is a perspective view of the main section of a modification of a spinal correction device according to the present invention

The footboard 250 is arranged so that it protrudes from the inside to the outside of the housing 210, blocking an opening 211 provided to one ceiling surface side of the housing 210. With reference to FIG. 16 as well, the footboard 250 is an integrally formed metal member of a dish-like shape comprising a bending part 251 along the periphery of a metal plate having a longitudinal shape. As illustrated in FIG. 14 and FIG. 16, a foot placement area 252L and a foot placement area 252R each marked with a sole shape are located on the front surface of the footboard 250 in opposing positions with a center axis M4 therebetween. Two rotating shaft installation members 261 and 262 are installed at the center of the back surface of the footboard 250, spaced apart in relation to a direction along the center axis M4 (Z direction). The rotating shaft installation members 261 and 262 respectively comprise a through-hole 261*h* and 262*h* along the center axis M4. Further, connecting member installation parts 263 and 264 that include bearings are provided on one side of the back surface of the footboard 250, spaced apart along an axis parallel to the center axis M4 (in the Z direction). That is, the axis center of the connecting member installation parts 263 and 264 and the axis center (M4) of the rotating shaft installation members 261 and 262 are offset by a predetermined distance.

Figure 17:
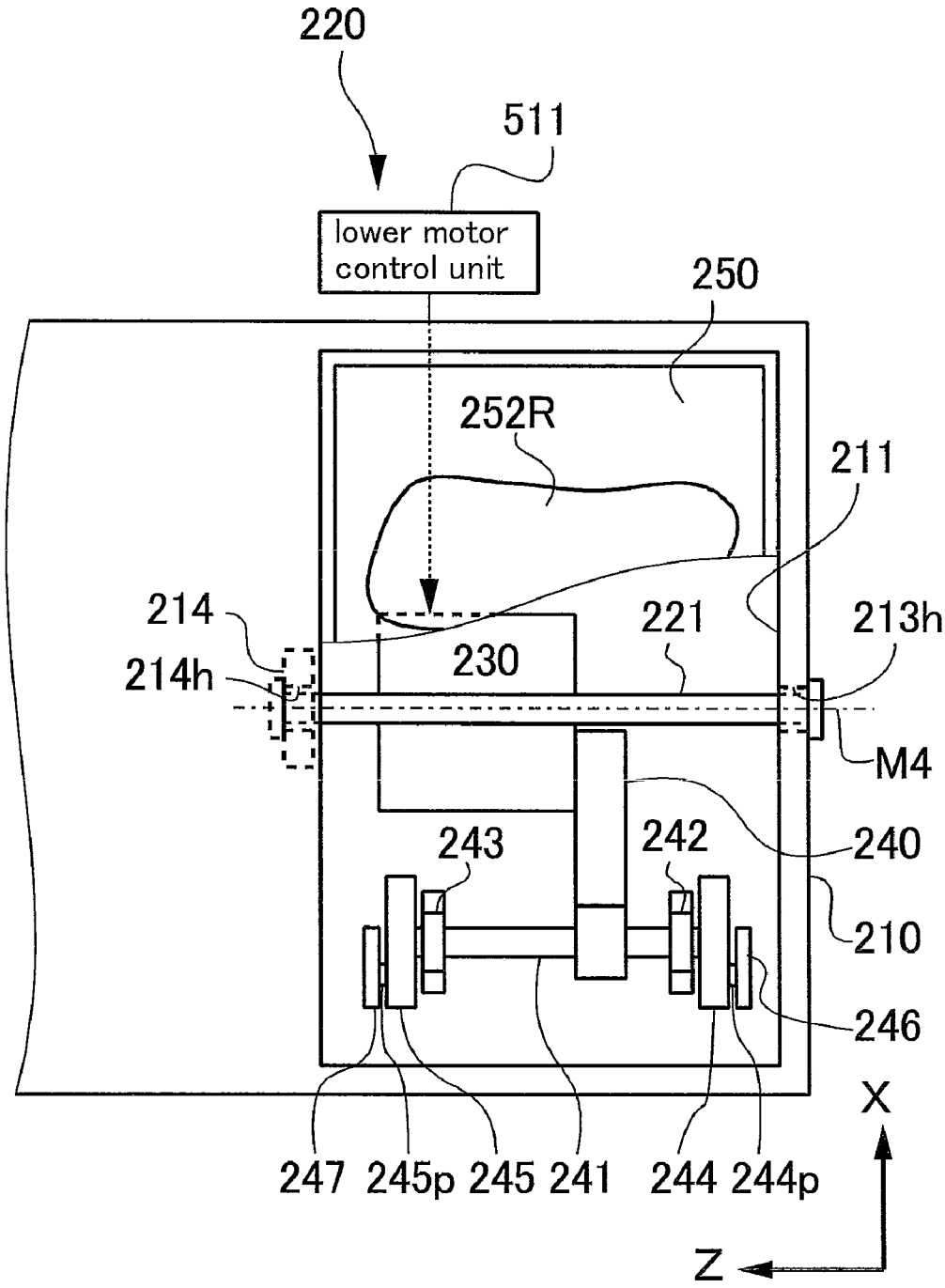
FIG. 17 is an upper view of the main section of a modification of a spinal correction device according to the present invention.

With reference to FIG. 16 and FIG. 17, a shaft 221 is inserted through the rotating shaft installation members 261 and 262. The shaft 221 communicates with a through-hole 213*h* provided at the substantial center of a side wall 212 of one side of the housing 210, and with a through-hole 214*h* provided opposite the through-hole 213 across the opening 211. With this arrangement, the footboard 250 swings about the center axis M4 of the shaft 221.

Next, the upper limb exercising part 400 will be described. As illustrated in FIG. 14, the upper limb exercising part 400 provided at the upper end of the four pillars 300 that extend in the perpendicular direction comprises an operation unit 403 provided beneath one side wall 402 of a housing 401 having a cube shape, and a pair of arms 480L and 480R that extend from an opening 404 of the one side wall 402 in the horizontal direction (the Z direction). A mechanism for adjusting the orientation of the gripping parts described later is provided to one end of each of the arms 480L and 480R. Further, the upper limb exercising part 400 comprises a mechanism 410 that adjusts the height of the housing 401, and a mechanism that operates the arms 480L and 480R.

Figure 18:
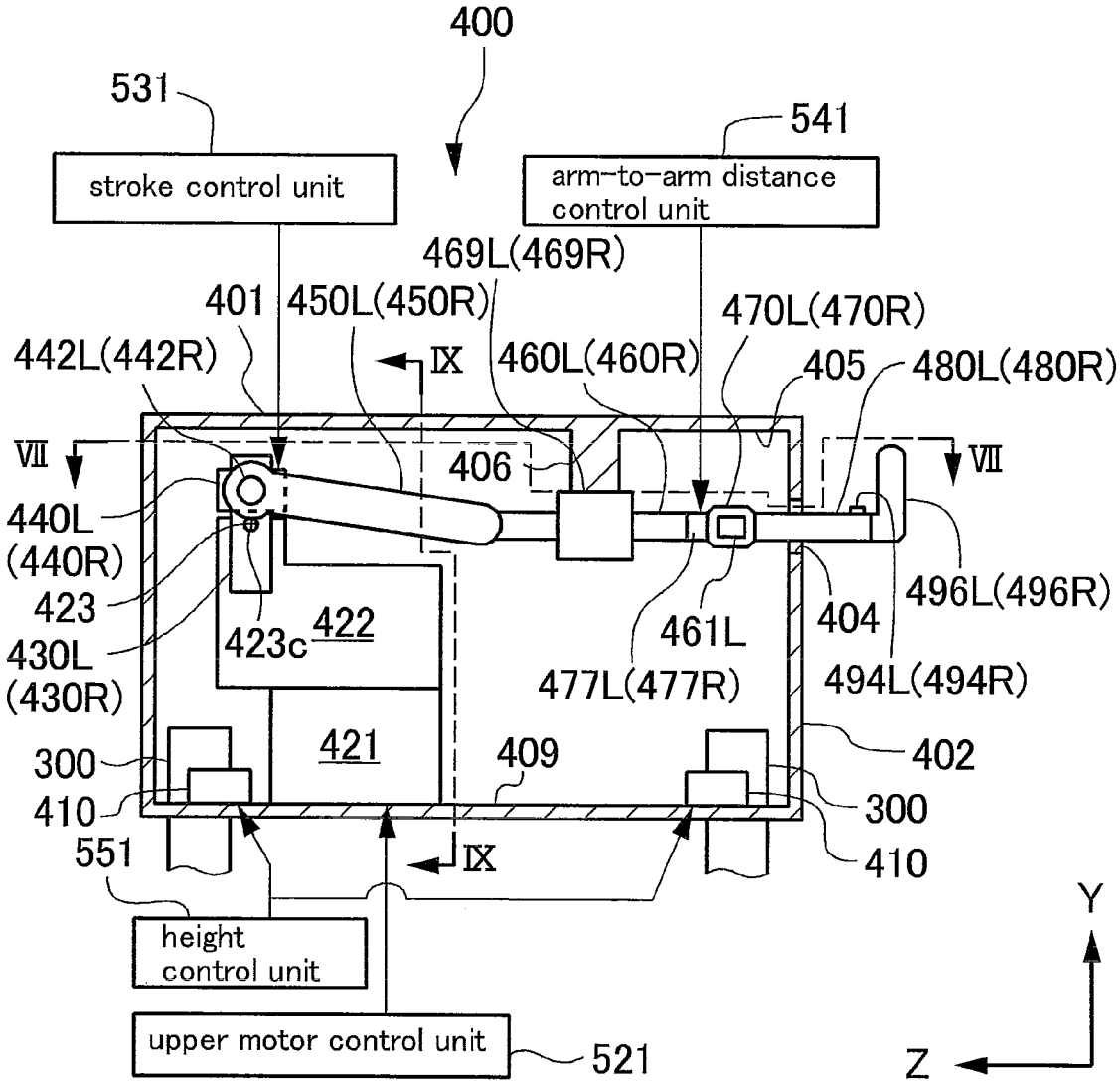
FIG. 18 is a cross-sectional view (cross-section V-V) of the main section of a modification of a spinal correction device according to the present invention.
Figure 25:
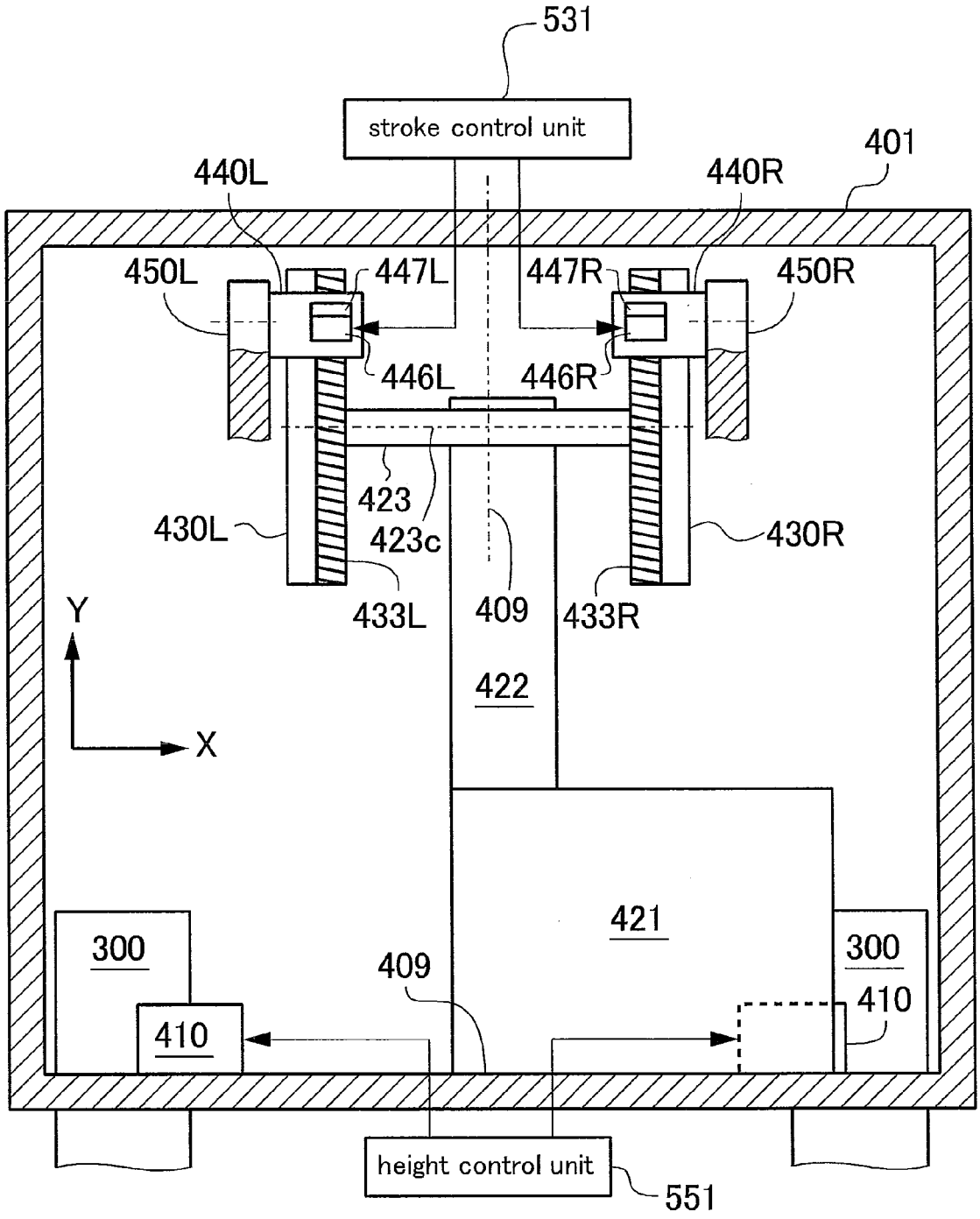
FIG. 25 is a cross-sectional view (cross-section IX-IX) of the main section of a modification of a spinal correction device according to the present invention.
Figure 26:
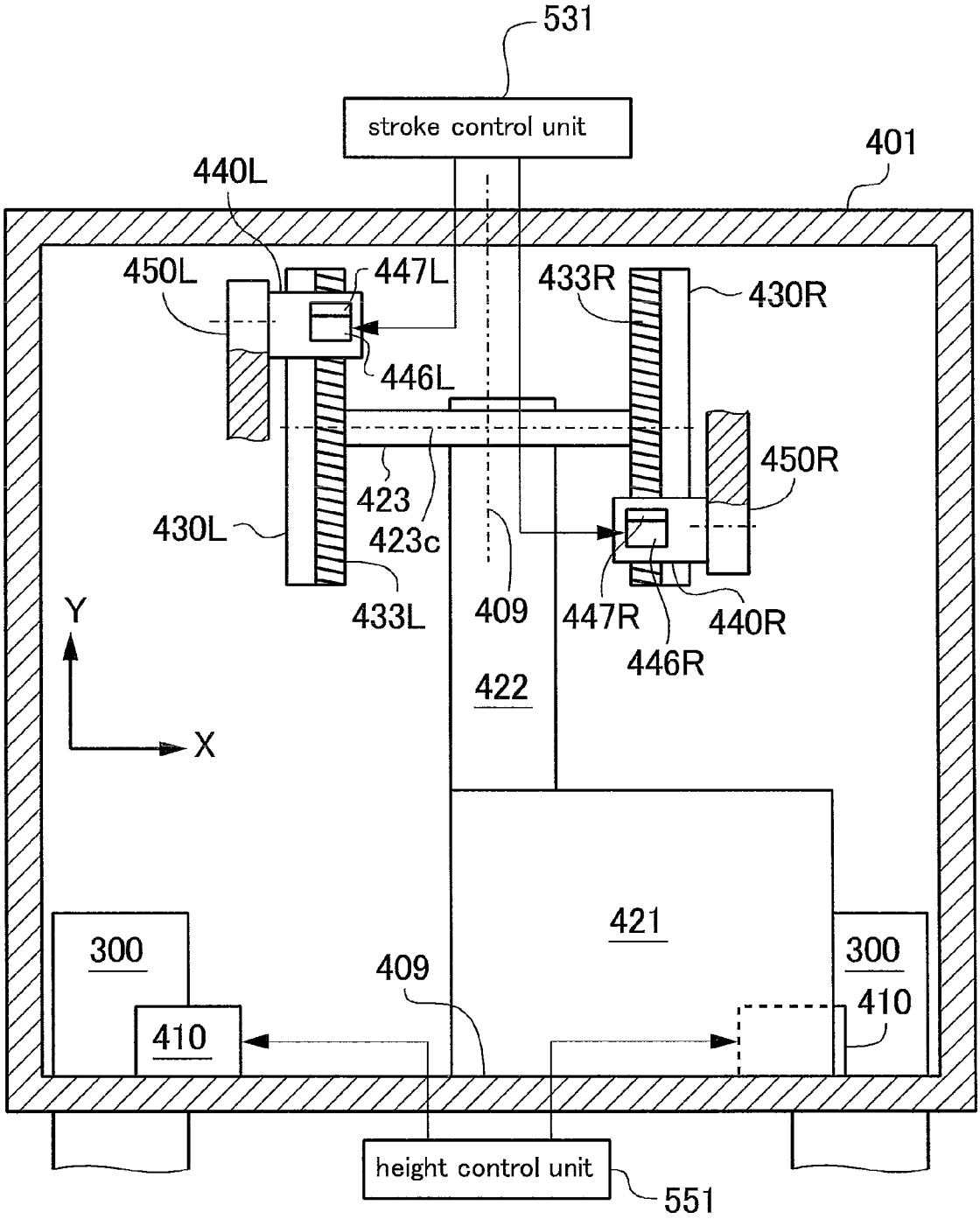
FIG. 26 is a cross-sectional view (cross-section IX-IX) of the main section of a modification of a spinal correction device according to the present invention.

As illustrated in FIG. 18 and FIG. 25, the height adjustment mechanism 410 housed in the housing 401 is provided near the upper end of each pillar 300. The height adjustment mechanism 410 comprises a rack gear, worm gear, motor, and the like (not shown).

Figure 23:
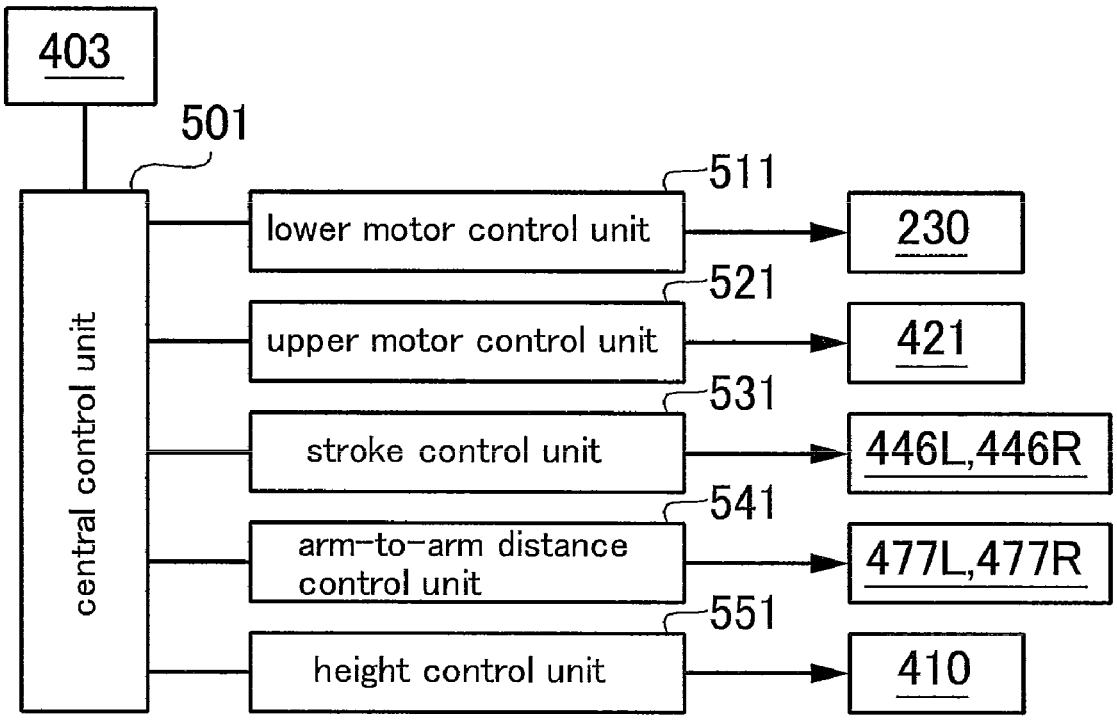
FIG. 23 is a control diagram of a modification of a spinal correction device according to the present invention.

As illustrated in FIG. 23, the height adjustment mechanism 410 adjusts the position of the housing 401 in the vertical direction (Y direction) when a user P operates the operation unit 403, causing a central control unit 501 to send a predetermined signal to a height control unit 551 and, upon receipt of this signal, the worm gear and the like within each height adjustment mechanism 410 to operate.

As illustrated in FIG. 18 and FIG. 25, the mechanism that operates the arms 480L and 480R comprises a driving unit 421, a power transmitting unit 422, a rotating shaft 423, a pair of crank arms 430L and 430R, a pair of slide members 440L and 440R, a pair of connecting rods 450L and 450R, and a pair of connecting rods 460L and 460R each having a bent section.

The driving unit 421 is arranged at the substantial center of a housing base 409. The driving unit 421 comprises a motor capable of controlling the frequency and the like, which is controlled by an upper motor control unit 521. The power transmitting unit 422 is arranged above the driving unit 421. The power transmitting unit 422 that includes a reduction gear that employs a gear, pulley, and the like transmits power from the driving unit 421 to the rotating shaft 423. The rotating shaft 423 is arranged so that it is supported by a supporting member (not shown) above the power transmitting unit 422, and has a rotational axis 423*c* thereof in the X direction.

Figure 22:
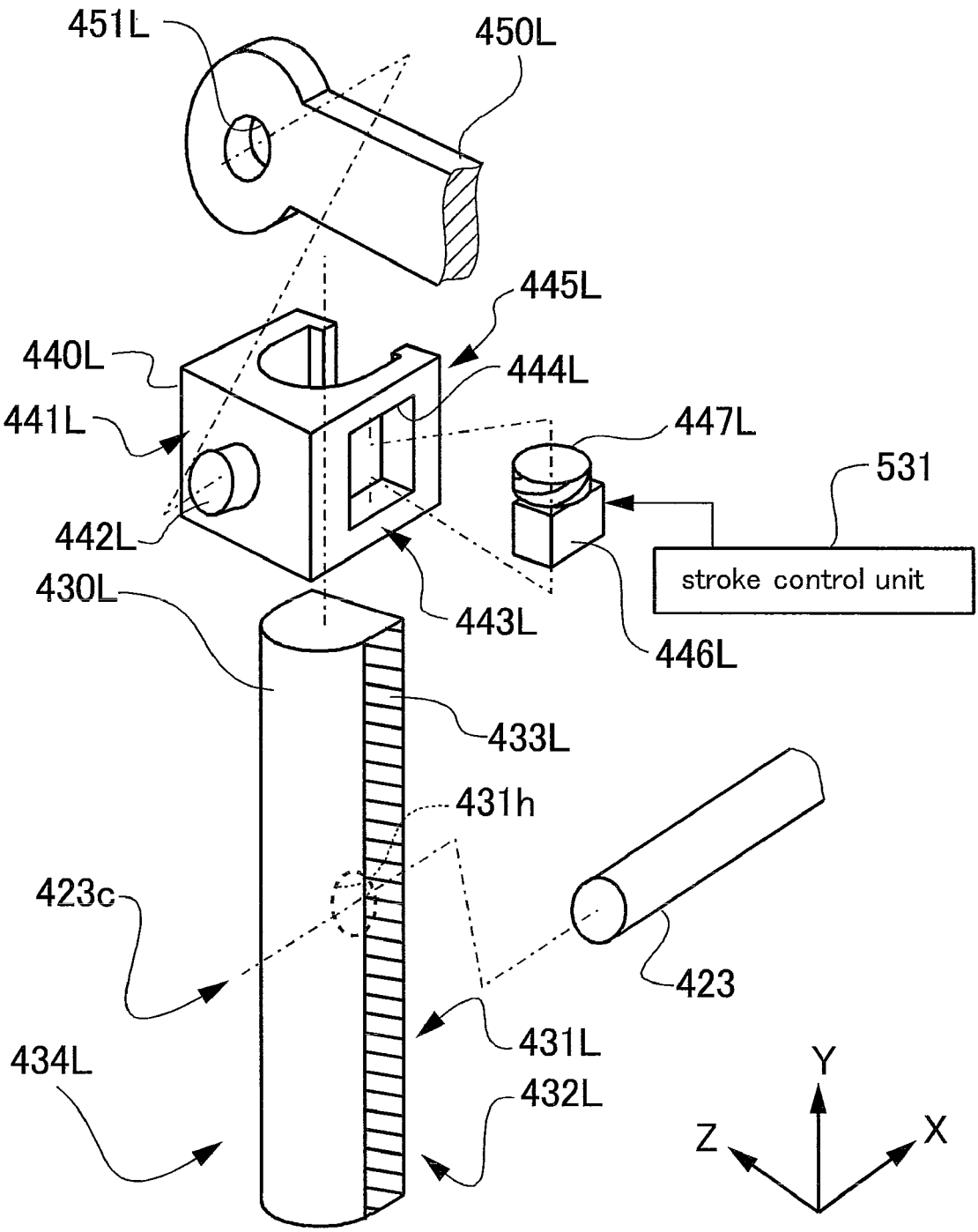
FIG. 22 is an exploded perspective view of the main section of a modification of a spinal correction device according to the present invention.

As illustrated in FIG. 22, the crank arm 430L of a substantial bar shape is installed to one end of the rotating shaft 423. The crank arm 430L has a long plane 431L in the vertical direction (Y direction) on one side thereof, and a circular hole 431*h* having the X axis as a center axis is provided to the center part of the plane 431L. The rotating shaft 423 solidly fits into the circular hole 431*h*. On a side wall surface 432L adjacent to the plane 431L, a rack gear 433L is cut across the entire surface thereof. A curved surface 434L opposite the plane 431L across the rack gear 433L has a substantially semicircular cross-section.

The slide member 440L is installed to the crank arm 430L. Specifically, the slide member 440L comprises a through-hole that passes through two planes (XZ planes) located there above and there below, a boss 442L provided to the center of one side surface 441L thereof, and a window 444L that opens in a rectangular shape and is provided to the center of a neighboring side wall 443L. The slide member 440L includes another side wall 445L that opens following a through-hole that passes through the two upper and lower planes. The cross-sectional shape of the through-hole that passes through the two upper and lower planes is substantially identical to the cross-sectional shape of the crank arm 430L, enabling the crank arm 430L to readily pass through that through-hole. The slide member 440L slides along the longitudinal direction of the crank arm 430L.

A worm gear 447L that engages with the rack gear 433L of the crank arm, and a stroke control motor 446L that rotates the worm gear 447L are arranged into window 444L.

The crank arm 430R (not shown) is installed to the other end of the rotating shaft 423. The crank arm 430R is designed with the same configuration as crank arm 430L, with the exception of having the symmetrical shape with respect to the virtual center plane 409 of the housing 400 (refer to FIG. 26), and thus a detailed description thereof will be omitted.

The slide member 440R (not shown) is installed to the crank arm 430R. The slide member 440R is designed with the same configuration as slide member 440L, with the exception of having the symmetrical shape with respect to the virtual center plane 409 of the housing 400 (refer to FIG. 26), and thus a detailed description thereof will be omitted. The slide member 440R slides along the longitudinal direction of the crank arm 430R.

A worm gear 447R that engages with a rack gear 433R of the crank arm, and a stroke control motor 446R that rotates the worm gear 447R are arranged into a window 444R (not shown).

As illustrated in FIG. 22, the connecting rod 450L is provided to the slide member 440L. Specifically, the boss 442L of the slide member 440L is inserted through a through-hole 451L provided to one end of the connecting rod 450L made of a metal plate having a predetermined length, and a bolt (not shown) is installed into the boss 442L to prevent the connecting rod from dropping.

Figure 20:
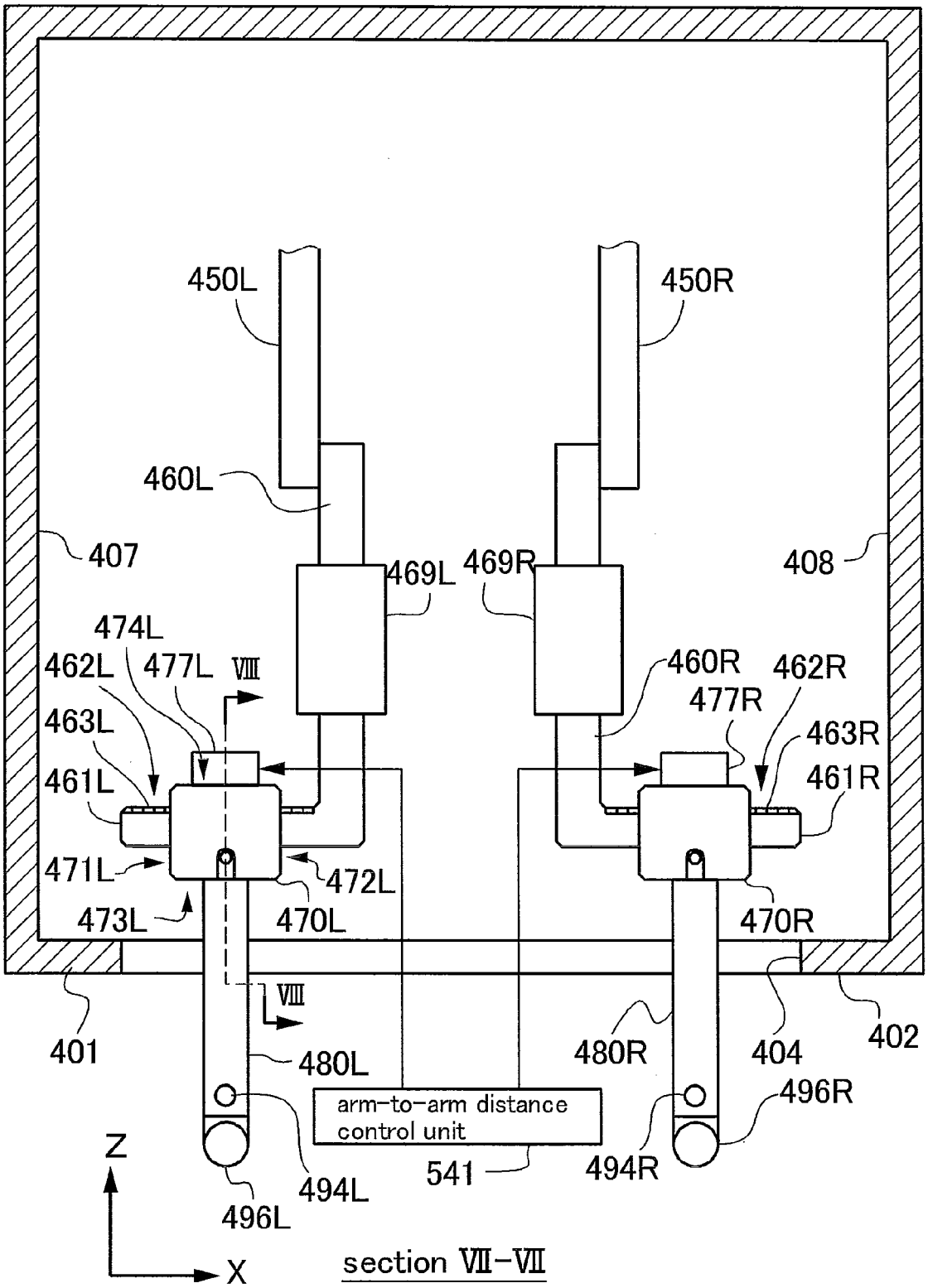
FIG. 20 is a cross-sectional view (cross-section VII-VII) of the main section of a modification of a spinal correction device according to the present invention.

As illustrated in FIG. 18 and FIG. 20, one end of the connecting rod 460L made of square metal bar is provided as axial support to the other end of the connecting rod 450L. Specifically, a boss provided to one end of the connecting rod 460L is inserted through a through-hole provided at the other end of the connecting rod 450L, and a bolt (not shown) is installed to the boss to prevent the rod from dropping.

The connecting rod 460L is inserted through a guide member 469L. The guide member 469L is made of a hollow rectangular tube and is fixed to a convex part 406 provided to a housing upper wall 405, creating an insertion through-hole in the Z direction. The connecting rod 460L is inserted through this insertion through-hole.

As is clear from FIG. 20, the other end of the connecting rod 460L bends into an L-shape toward a housing side surface 407. On one side plane 462L of this bending part 461L, a rack gear 463L is cut across the entire surface thereof.

The connecting rod 450R is axially located to the slide member 440R (not shown). The connecting rod 450R has the same shape as the connecting rod 450L, and a detailed description thereof will be omitted.

As illustrated in FIG. 18 and FIG. 20, One end of the connecting rod 460R made of square metal bar is provided as axial support to the other end of the connecting rod 450R. Specifically, a boss provided to one end of the connecting rod 460R is inserted through a through-hole provided at the other end of the connecting rod 450R, and a bolt (not shown) is installed to the boss to prevent the rod from dropping. The connecting rod 460R is inserted through a guide member 469R. The guide member 469R is made of a hollow rectangular tube and is fixed to a convex part 406 provided to a housing upper wall 405, creating an insertion through-hole in the Z direction. The connecting rod 460R is inserted through this insertion through-hole.

As is clear from FIG. 20, the other end of the connecting rod 460R bends into an L-shape toward a housing side surface 408. On one side plane 462R of this bending part 461R, a rack gear 463R is cut across the entire surface thereof.

Figure 21:
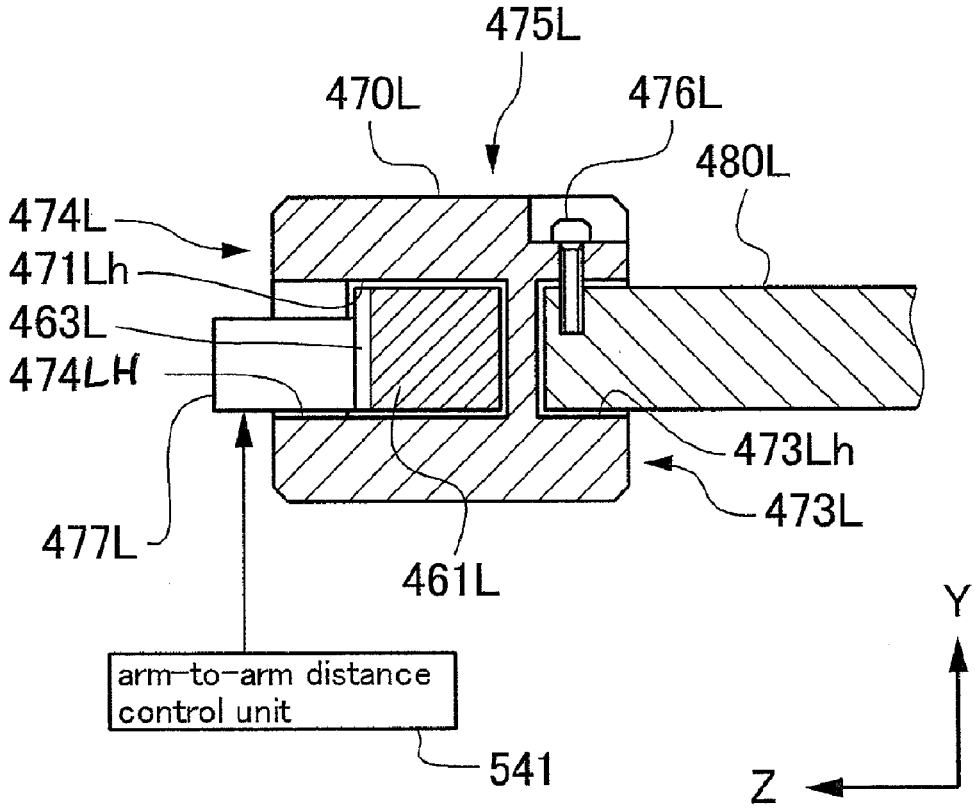
FIG. 21 is a cross-sectional view (cross-section VIII-VIII) of the main section of a modification of a spinal correction device according to the present invention.

Next, the mechanism for adjusting the distance between the arm 480L and the arm 480R will be described with reference to FIG. 20 and FIG. 21.

A joint 470L is installed to the bending part 461L, which is the other end of the connected rod 460L. Specifically, the joint 470L that forms a substantially cubed shape comprises a through-hole 471Lh of a rectangular cross-sectional shape that passes through the center of side surfaces 471L and 472L in the X direction, a shallow hole 473Lh having a rectangular cross-sectional shape cut through the center of another side surface 473L in the Z direction, and a through-window 474LH of a rectangular cross-sectional shape cut through the center of the another side surface 474 in the Z direction.

The bending part 461L is inserted in a slidable manner through the through-hole 471Lh of the joint 470L. One end of the arm 480L is fit to the shallow hole 473Lh. The upper part of one end of the arm 480L and an upper surface 475L of the joint 470L are fixed by a screw 476L. A power mechanism 477L which includes a worm gear and control motor is arranged on the through-window 474Lh so as to engage with the rack gear 463L.

A joint 470R is installed to the bending part 461R, which is the other end of the connected rod 460R. The joint 470R has the same shape as the joint 470L and is installed to the bending part 461R thereof in the same manner as in the case of the bending part 461L, and a detailed description thereof will be omitted. Similar to the joint 470L, a shallow hole 473RH (not shown) of the joint 470R is fit to one end of the arm 480R.

The two arms 480L and 480R that extend in the Z direction pass through the opening 404, causing the other ends thereof to extend to the outside of the housing.

The operation of the mechanism for adjusting the distance between the two arms will now be described in general with reference to FIG. 14, FIG. 20 and FIG. 23.

When the user P operates the operation unit 403, the central control unit 501 sends a predetermined signal to an arm-to-arm distance control unit 541 and, upon receipt of that signal, each motor within the power mechanisms 477L and 477R controls the rotational angle thereof. With this control, the width (distance in the X direction) of the arm 480L and the arm 480R is adjusted.

Figure 19A:
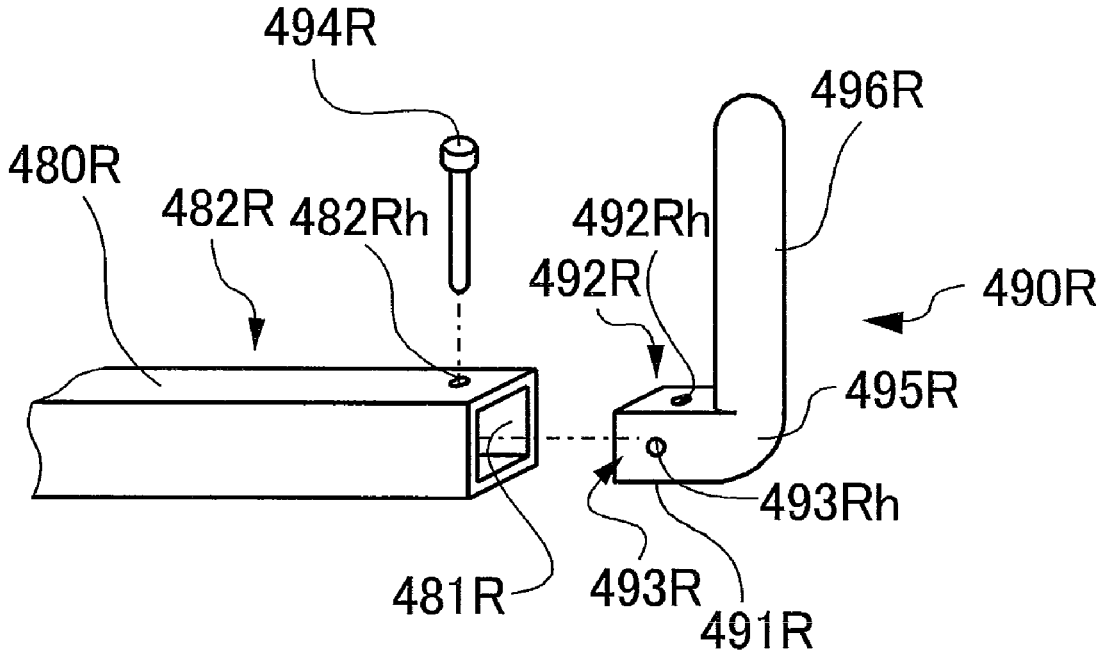
FIG. 19A and FIG. 19B are exploded perspective views of the gripping part of a modified spinal correction device according to the present invention.
Figure 19B:
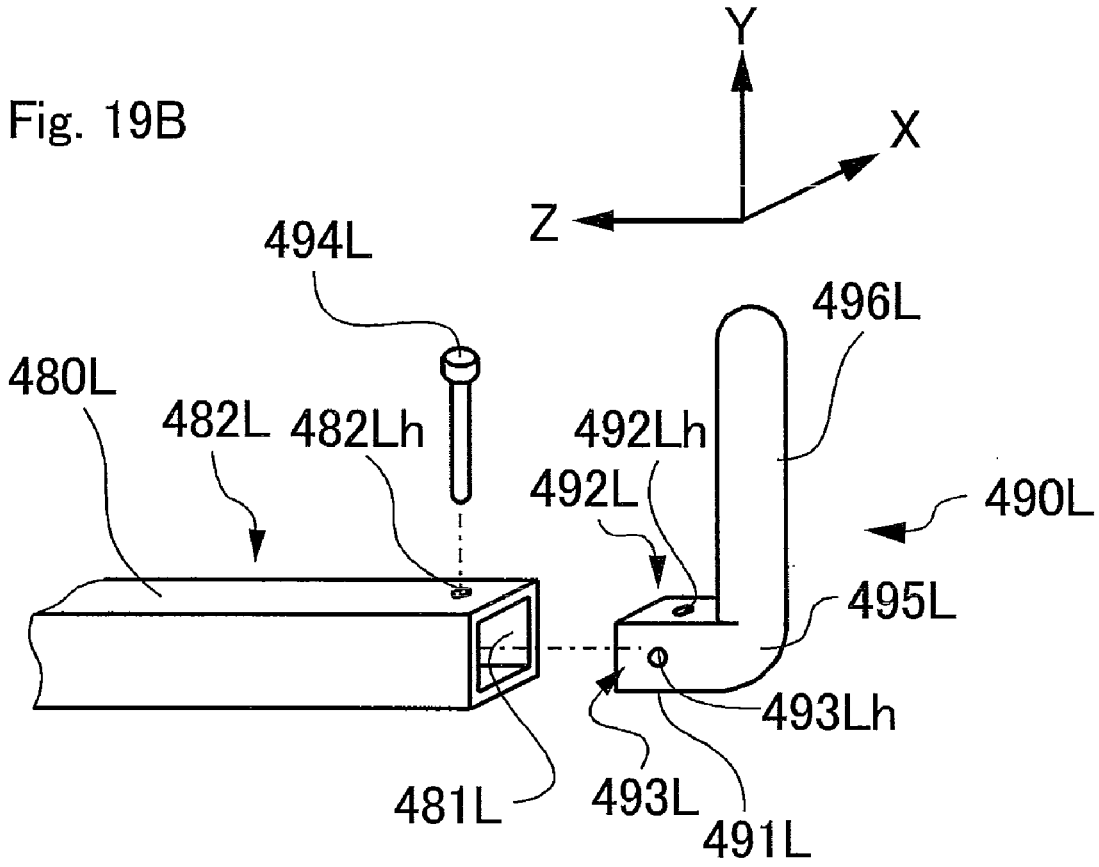

Next, the mechanism for adjusting the orientation of the gripping parts will be described with reference to FIG. 19A, FIG. 19B, and FIG. 20.

The other end of the arm 480L comprises an opening 481L and a through-hole 482LH that passes through an arm upper surface 482L. A handle 490L is installed to the opening 481L.

Specifically, one end of the handle 490L comprises a fitting part 491L, a threaded hole 492Lh that passes through the upper surface 492L of one end of the handle, and a threaded hole 493Lh that passes through one side plane 493L of one end of the handle.

The handle 490L bends into an L-shape in the upward direction (the Y direction) at a substantial center 495L thereof, and has a gripping part 496L at the other end thereof.

The cross-section of the fitting part 491L has substantially the same rectangular shape as the cross-sectional inner periphery of the opening 481L, and one end of the handle fits into the other end of the arm 480L. The fitting part 491L fits into the opening 481L of the arm 480L and a bolt 494L communicates with and is threaded into the through hole 482L and the threaded hole 492Lh, thereby fixing the handle 490L to the other end of the arm 480L.

The other end of the arm 480R comprises an opening 481R and a through-hole 482Rh that passes through an arm upper surface 482R. A handle 490R is installed to the opening 481R. The handle 490R has the same shape as the handle 490L, and a detailed description thereof will be omitted. The cross-section of a fitting part 491R has substantially the same rectangular shape as the cross-sectional inner periphery of the opening 481R, and one end of the handle fits into the other end of the arm 480R. The method of securing the handle 490R to the other end of the arm 480R is the same as in the case of the handle 490L, and a description thereof will be omitted.

The method of adjusting the orientation of the gripping part will now be described with reference to FIG. 19A and FIG. 19B. In a case where the handle 490L is installed to the other end of the arm 480L and the bolt 494L is communicated with and threaded into the through-hole 482Lh and the threaded hole 492Lh, the gripping part 496L is positioned in the vertical direction. On the other hand, in a case where the bolt 494L is communicated with and threaded into the through-hole 482Lh and the threaded hole 493Lh, the gripping part 496L is positioned in the horizontal direction. In this manner, the orientation of the gripping part 496L of the handle 490L is suitably changed. The structure of a gripping part 496R of the handle 490R is the same as that in the case of the handle 490L, and thus the orientation of the gripping part 496R is also changed in this same manner.

The method of using the spinal correction device according to this embodiment will now be described in detail.

First, the method of adjusting the height of the gripping parts 496L and 496R will be described with reference to from FIG. 24A to FIG. 24E.

Figure 24A:
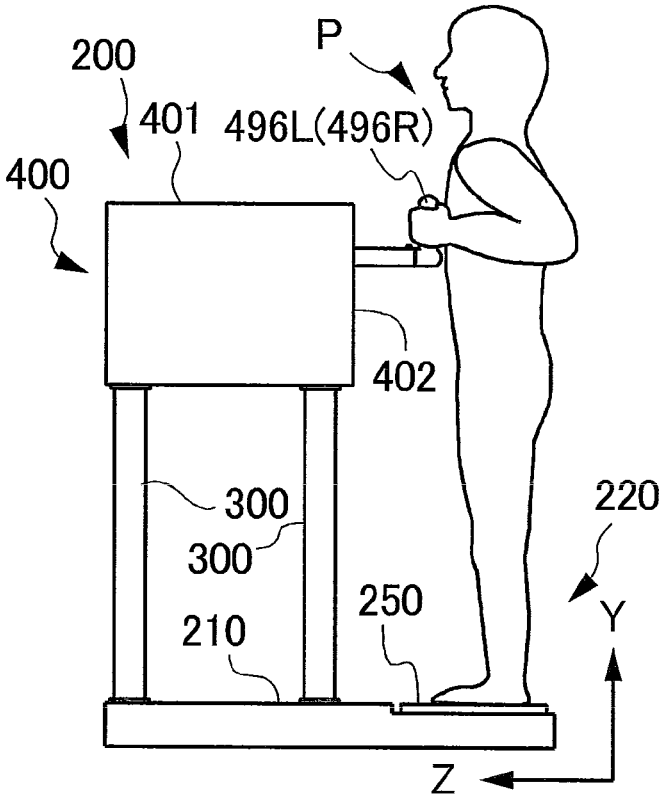
FIG. 24A is a side view of a modification of a spinal correction device according to the present invention.
Figure 24B:
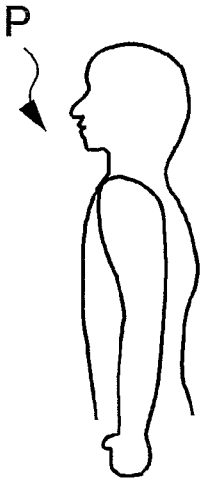
FIGS. 24B to 24E illustrate a method by which a user adjusts the height of the gripping parts.
Figure 24C:
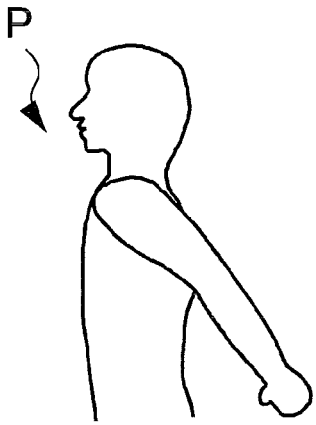
Figure 24D:
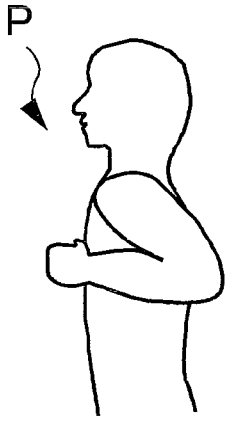

As illustrated in FIG. 24A, the user P stands with his or her left foot and right foot placed on the foot placement area 252L and the foot placement area 252R of the footboard 250, respectively, so that he or she is facing the one side wall 402 of the housing 401. Next, as illustrated in FIG. 24B, the user P in an erect state lowers his or her upper arms along his or her trunk. Then, as illustrated in FIG. 24C, the user P brings his or her elbow joints rearward from the shoulder joints. With the elbow joints brought rearward, the thorax opens, causing the chest to be in a stretched state. In this state, as illustrated in FIG. 24D, the user P moves his or her arms from the elbow joints so that the forearms become horizontal. In this state, without moving the upper limbs or lower limbs, the user P adjusts the height of the gripping parts 496L and 496R so that he or she can grip the gripping part 496L with his or her left hand and the gripping part 496R with his or her right hand. Note that the operation of the device for adjusting the height of the gripping parts 496L and 496R, that is, the operation of the device for adjusting the height of the upper limb exercising part 400, has already been described, and a description thereof will be omitted.

The method of adjusting the distance in the X direction between the gripping parts 496L and 496R will now be described.

Figure 24E:
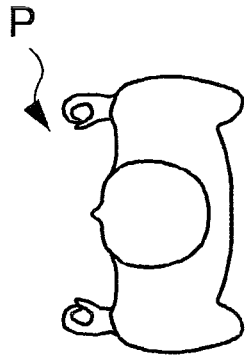

In the state illustrated in FIG. 24D, that is, in FIG. 24E which illustrates a planar view of the user P, the distance in the X direction between the gripping parts 496L and 496R is adjusted so that both arms maintain the distance of the shoulder width. Note that the operation of the device for adjusting the distance in the X direction between the gripping parts 496L and 496R, that is, the operation of the device for adjusting the distance between the arms 480L and 480R (the X direction), has already been described and a description thereof will be omitted.

The significance of adjusting the orientation of the gripping parts and the impact on the shoulder joint from differences in the method of gripping will now be described.

When the user P grips the gripping parts 496L and 496R with the gripping parts 496L and 496R positioned vertically (in the Y direction), the orientation of the wrist joint with respect to the elbow joint of the user P is in an intermediate position facing upward, resulting in minimal load to the wrist joint. When the user P grips the gripping parts 496L and 496R with the gripping parts 496L and 496R positioned horizontally (in the X direction), the orientation of the wrist with respect to the elbow joint of the user P becomes supinated or pronated.

Figure 27:
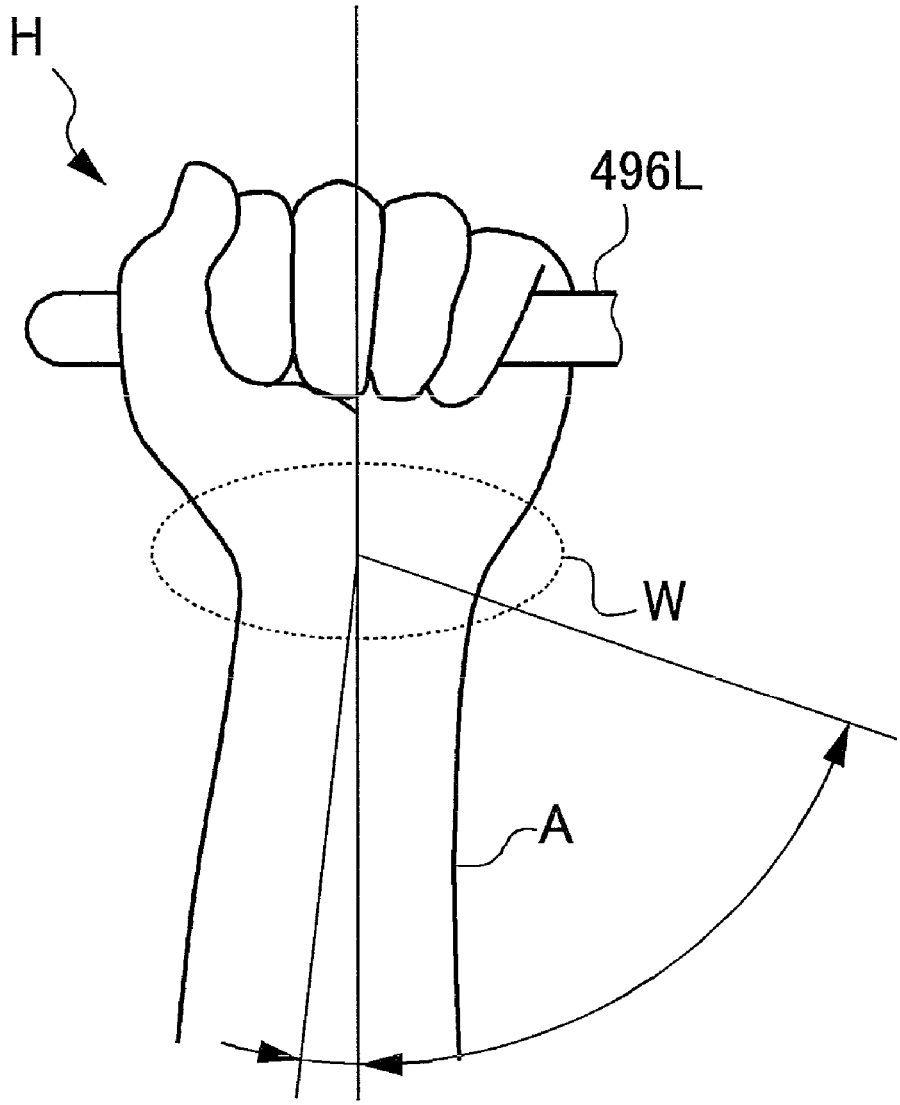
FIG. 27 is a view of a spinal correction device and modification according to the present invention

FIG. 27 is a planar view from above of the left hand gripping the gripping part 496L in a supinated position. In this case, for a hand H gripping the gripping part 496L, it is difficult to position a forearm A of the user P away from the upper limb. It is difficult to use wrist W as the fulcrum point to open the underarm region of the upper limb since it is difficult to bend wrist W. On the other hand, when the left hand grips the gripping part 496L in a pronated position (not shown), it is easy to position the forearm A of the user P away from the upper limb. It is easy to use the wrist W as the fulcrum point to open the underarm region of the upper limb since the wrist W bends.

In the inventive device of this embodiment, when the user P grips the gripping parts 496L and 496R in a supinated position, the forearm A is maintained in a state which does not separate from the upper limb (the underarm region of the upper limb tightens) in response to the back-and-forth reciprocating motion of the gripping parts 496L and 496R, thereby efficiently transmitting the back-and-forth reciprocating motion of the gripping parts to the shoulder joints of the user P and further opening the thorax, and thus the supinated position is preferred.

On the other hand, when the user P grips the gripping parts 496L and 496R in a pronated position, the forearm A readily separates from the upper limbs (the underarm region of the upper limb readily opens), thereby decreasing the load placed on the shoulder joints.

The method of adjusting the reciprocating stroke of the arm group will now be described. First, the method of adjusting the reciprocating stroke of the arm 480L will be described with reference to FIG. 14, FIG. 18, FIG. 22, FIG. 23 and FIG. 25. When the user P operates the operation unit 403, the central control unit 501 sends a predetermined signal to a stroke control unit 531 and, upon receipt of that signal, the stroke control motor 446L controls the rotational angle thereof. With such control, the distance between the boss 442L of the slide member 440L and the rotational axis 423*c* of the rotating shaft 423 is adjusted. The connecting rod 450L reciprocates in an amount equivalent to twice the distance between the boss 442L of the slide member 440L and the rotational axis 423*c* of the rotating shaft 423. The reciprocating motion of the connecting rod 450L is transmitted to the connecting rod 460L connected thereto, causing the reciprocating motion to be transmitted to the arm 480L connected to the connecting rod 460L. Thus, the reciprocating stroke of the arm 480L is adjusted by suitably adjusting the distance between the boss 442L of the slide member 440L and the rotational axis 423*c* of the rotating shaft 423. The reciprocating stroke of the arm 480R is also adjustable using this same method.

The reciprocating stroke of the arms 480L and 480R is preferably less than or equal to the thickness of the thorax of the user P, and more preferably 2 to 3 cm. When the stroke of the reciprocating motion is too large, the motion imparted to the shoulder joints is too large, imparting an excessive load to the trunk of the user P. Note that adjustment of the reciprocating stroke of the arm group is essentially equivalent to the adjustment of the reciprocating stroke of the gripping part group.

With reference to FIG. 25, when the user P uses the inventive device according to this embodiment and operates the operation unit 403, because the lengths of the reciprocating strokes of the arm 480L and the arm 480R are made to be the same, the slide members 440L and 440R inserted through each crank arm are moved to opposing positions on either side of the virtual center plane 409 of the housing 400. In the initial state, the crank arms 430L and 430R are arranged so that the bosses 442L and 442R of the slide member are in positions farthest away from the one side wall 402 (refer to FIG. 18), and the gripping parts 496L and 496R are arranged in positions farthest away from the standing user P.

The power mechanism and the operation of the lower limb exercising part 220, and the setting of parameters related to lower limb motion will now be described.

Figure 15:
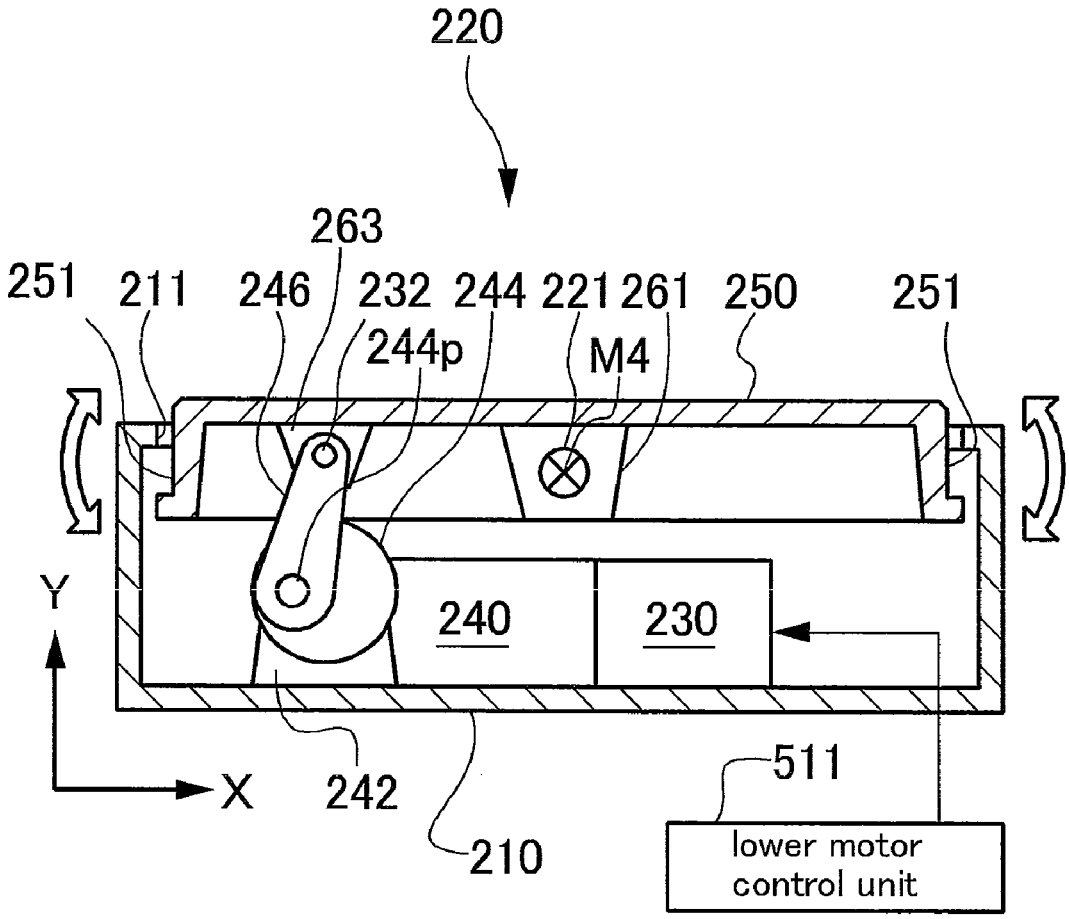
FIG. 15 is a cross-sectional view (cross-section VI-VI) of the main section of a modification of a spinal correction device according to the present invention.

With reference to FIG. 15 to FIG. 17, the power transmitting unit 240 that receives power from the driving unit 230 that includes a motor is arranged inside the housing 210. The power transmitting unit 240 rotates a shaft 241 having a rotational axis along the Z axis located underneath one side of the footboard 250. Stays 242 and 243 that include bearings are provided on both sides of the shaft 241. Crank circular plates 244 and 245 are fixed to both ends of the shaft 241. Convex parts 244*p* and 245*p* are provided in the Z axial direction on the crank circular plates 244 and 245, at positions having equivalent amounts of offset in the same outer peripheral direction from that rotational axis. One end of each of identical connecting members 246 and 247 each having an insertion hole on both ends is rotatably installed to the convex parts 244*p* and 245*p*. The other end of the connecting member 246 is rotatably connected by a crank pin 232 to the connecting member installation part 263 of the footboard 250. The other end of the connecting member 247 is rotatably connected by the crank pin 232 to the connecting member installation part 264 (refer to FIG. 16). Rotation of the crank circular plates 244 and 245 swing the footboard 250 using the center axis M4 as the fulcrum point, via the connecting members 246 and 247. That is, the foot placement areas 252L and 252R of the footboard 250 are symmetrically located with respect to the center axis M4, and therefore move in coordination in opposite phases.

Note that the vertical stroke in the vicinity of the foot placement area 252L and the foot placement area 252R of the footboard 250 is preferably 3 cm or less.

The swing of the footboard 250 imparts a vertical motion to the pelvis at horizontally symmetrical positions with respect to the spinal column, via the lower limbs of the user P. In this case, the load on the knees that absorb the vertical motion increases, making it difficult for the user P to bend his or her knees. As a result, the user P receives the motion of this device with his or her knees in a stretched state, that is, in a standing state.

The user P, by operating the operation unit 403, starts the footboard 250 of the lower limb exercising part 220 at a desired frequency, preferably within the range of 2 to 22 Hz. After startup as well, the user P can change the frequency of the footboard 250 by operating the operation unit 403.

The power mechanism of the upper limb exercising part and the operation thereof have already been described. The user P operates the operation unit 403 to start the arms 480L and 480R of the upper limb exercising part 400 at a desired frequency, preferably within the range of 2 to 22 Hz.

Next, the movement of the user P in association with the gripping parts 496L and 496R that reciprocate back and forth will now be described. In response to the user P gripping the gripping parts 496L and 496R with both hands with his or her thorax open, the forearms of the user P move substantially parallel from frontward positions to rearward positions when the gripping parts 496L and 496R begin motion from positions farthest away from the user P (the initial state) in a direction that brings the gripping parts 496L and 496R closer to the user P. As a result, the elbow joints cannot absorb the motion of the gripping parts 496L and 496R, causing the forearms to be pushed rearward, moving the elbow joints and upper arms substantially horizontally rearward. The shoulder joints of the user P in a state with his or her thorax open are then pressed rearward. The thorax of the user P is in an open state, making it impossible for the shoulder joints to further rotate. As a result, the thorax of the user P opens further. Note that, if an attempt is made to place an excessive load on the shoulder joints, thorax, etc., of the user P by the operation of the gripping parts 496L and 496R, the trunk of the user P is pushed back toward the back surface side, thereby preventing the excessive load from impacting the shoulder joint, thorax, etc. When the gripping parts 496L and 496R move in a direction away from the closest position to the user P in a standing state, the user P returns once again to the initial state.

In the invention according to this embodiment, the motion of the gripping parts 496L and 496R is executed in opposite phases. This opposite phase motion is made possible by operating the operation unit 403, similar to that in the case of same phase operation. Accordingly, when the gripping part 496L is in the forward position, the gripping part 496R is in the rearward position.

According to the inventive device of this embodiment, the frequency of the reciprocating motion of the gripping part 496L and the gripping part 496R and the frequency of the seesaw motion of the footboard 250 are independently adjusted. With this arrangement, the user P himself or herself can adjust the frequency of each device in accordance with his or her physical condition, etc.

Further, the motion of the upper limbs and lower limbs may be finely adjusted by a chiropractic specialist while the specialist observes the state of the spinal column of the user P.

Furthermore, for example, in a case where the frequency of both gripping parts and the frequency of the footboard are made identical, the phases can be adjusted so that the phase of the gripping parts 496L and 496R is reversed and, when the gripping part 496L reaches the front-most position (the position farthest away from the user P), the foot placement area 252L reaches the highest position.

Furthermore, the frequency of the gripping parts 496L and 496R and the frequency of the footboard 250 may be set so that they are different.

With the operation unit 403, a signal can be inputted so that only one of the driving units among the driving unit 421 of the upper limbs and the driving unit 230 of the lower limbs is driven, making it possible to use the device as an exercise device that imparts motion to only the upper limbs or the lower limbs.

As another embodiment, a cam mechanism may be provided in place of the crank arms 430L and 430R to impart a back-and-forth reciprocating motion to the gripping part 496R while the gripping part 496L is static, and subsequently impart a back-and-forth reciprocating motion to the gripping part 496L while the gripping part 496R is static. The operation mechanism thereof is substantially the same as that of the above-described embodiment, and a detailed description will be omitted.

Furthermore, while representative embodiments according to the present invention and modifications based thereon have been described, the present invention is not limited thereto. It will be apparent to those skilled in the art that various modifications and variations can be made in the present invention without departing from the spirit or scope of the present invention.

What is claimed is:

1. A spinal correction device that corrects a spinal column of a user, comprising:

a lower limb exercising part including a footboard to alternatingly move one of left and right lower limbs of said user in a standing state in an upward vertical direction with a frequency range of 2 to 22 Hz while simultaneously moving the other of the left and right lower limbs in a downward vertical direction, thereby stabilizing a position of a lumbar region of said user, and transmitting short and quick oscillation to a vertebrae of the spinal column of said user;

a pair of gripping parts provided in a position in front of said lower limb exercising part, the gripping parts being adapted to be gripped by both hands of said user; and a control unit connected to a driving motor, wherein when the spinal correction device is in a driven state, the driving motor is adapted to rotate said gripping parts with respect to said lower limb exercising part between said position in front of said lower limb exercising part and a lateral position.

2. The device according to claim 1, wherein said footboard moves in a seesaw motion.

3. The device according to claim 1 further comprising:

a rotating vertical pillar mounted forward of the lower limb exercising part, a single rod arranged horizontally and mounted at a longitudinal center (C) thereof to an upper end of the rotating vertical pillar, wherein the gripping parts are provided at opposite ends of the single rod.

4. The device according to claim 3, wherein the rotating vertical pillar has a rotational axis (M2), and the single rod has a rotational axis that is coaxial with the rotational axis (M2) of the rotating vertical pillar, so that during rotation of the rotating vertical pillar and the single rod, the single rod provided with the pair of gripping parts maintains a horizontal orientation.

* * * * *